US006209652B1

(12) United States Patent
Portman et al.

(10) Patent No.: US 6,209,652 B1
(45) Date of Patent: Apr. 3, 2001

(54) DEPLOYMENT SYSTEM METHOD AND APPARATUS FOR RUNNING BOTTOMHOLE ASSEMBLIES IN WELLS, PARTICULARLY APPLICABLE TO COILED TUBING OPERATIONS

(76) Inventors: Lance N. Portman, 64 N. York Gate Ct., The Woodlands, TX (US) 77382; John E. Ravensbergen, 975 MacKenzie Drive, S.E., Calgary, Alberta (CA), T2Z 1S6

( * ) Notice: Subject to any disclaimer, the term of this patent is extended or adjusted under 35 U.S.C. 154(b) by 0 days.

(21) Appl. No.: 09/355,077

(22) PCT Filed: Feb. 3, 1998

(86) PCT No.: PCT/US98/01930

§ 371 Date: Jul. 22, 1999

§ 102(e) Date: Jul. 22, 1999

(87) PCT Pub. No.: WO98/34005

PCT Pub. Date: Aug. 6, 1998

Related U.S. Application Data

(60) Provisional application No. 60/037,407, filed on Feb. 3, 1997.

(51) Int. Cl.[7] ..... E21B 19/22

(52) U.S. Cl. ..... 166/379; 166/85.4; 166/85.3; 166/88.3; 166/382; 166/387; 166/77.2

(58) Field of Search ..... 166/85.4, 85.3, 166/88.1, 88.3, 379, 382, 387, 77.2

(56) References Cited

U.S. PATENT DOCUMENTS

| | | | | |
|---|---|---|---|---|
| 3,003,560 | | 10/1961 | Corley . | |
| 3,150,717 | | 9/1964 | Otteman . | |
| 3,308,880 | | 3/1967 | Yetman . | |
| 4,460,039 | | 7/1984 | Knight . | |
| 4,494,609 | | 1/1985 | Schmendemann . | |
| 4,577,687 | | 3/1986 | Lanmon . | |
| 4,646,844 | | 3/1987 | Roche et al. . | |
| 4,681,168 | | 7/1987 | Kisling . | |
| 4,836,289 | | 6/1989 | Young . | |
| 4,915,178 | | 4/1990 | Goldschild . | |
| 4,995,457 | | 2/1991 | Baldridge . | |
| 5,088,559 | | 2/1992 | Taliaferro . | |
| 5,515,925 | | 5/1996 | Boychuk . | |
| 5,515,926 | | 5/1996 | Boychuk . | |
| 5,522,464 | | 6/1996 | Piper et al. . | |
| 5,544,706 | | 8/1996 | Reed . | |
| 5,697,439 | | 12/1997 | Kopfman et al. . | |
| 5,727,631 | | 3/1998 | Baker et al. . | |
| 5,810,087 | * | 9/1998 | Patel | 166/373 |
| 5,823,266 | * | 10/1998 | Burleson et al. | 166/380 |
| 5,848,646 | * | 12/1998 | Huber et al. | 166/297 |
| 5,950,733 | * | 9/1999 | Patel | 166/373 |
| 5,957,209 | * | 9/1999 | Burleson et al. | 166/380 |

* cited by examiner

*Primary Examiner*—Roger Schoeppel
(74) *Attorney, Agent, or Firm*—Sue Z. Shaper; Felsman, Bradley, Vaden, Gunter & Dillon, LLP

(57) ABSTRACT

A deployment system and apparatus for running bottomhole assemblies and/or downhole tools in wells, particularly applicable to coiled tubing operations, including pressurized deployment apparatus, a pressure operated connector tool and a multi-functional coiled tubing head.

25 Claims, 24 Drawing Sheets

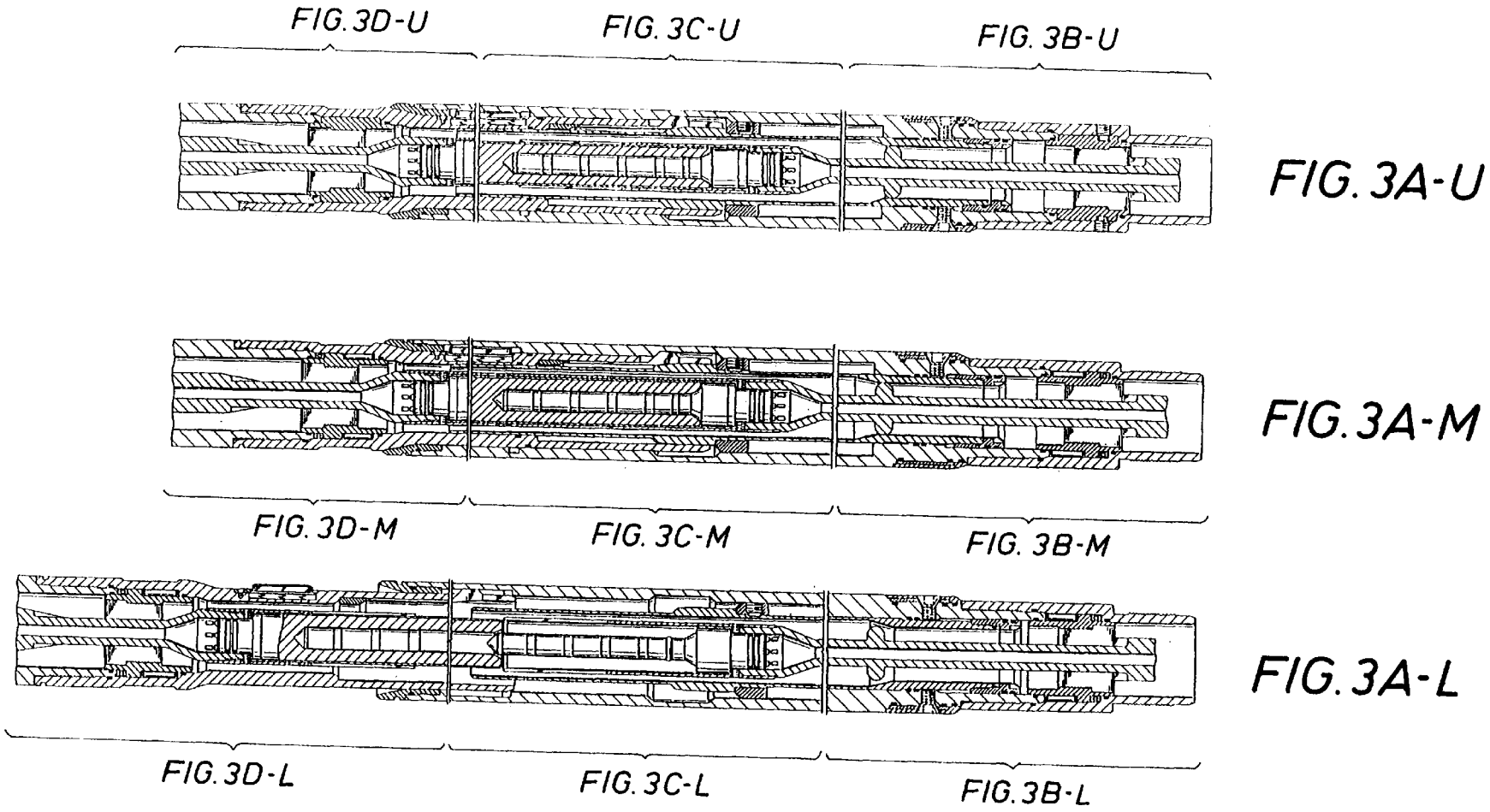
FIG. 3A-U
FIG. 3A-M
FIG. 3A-L
FIG. 3B-U
FIG. 3C-U
FIG. 3D-U
FIG. 3B-M
FIG. 3C-M
FIG. 3D-M
FIG. 3B-L
FIG. 3C-L
FIG. 3D-L FIG. 3B-U
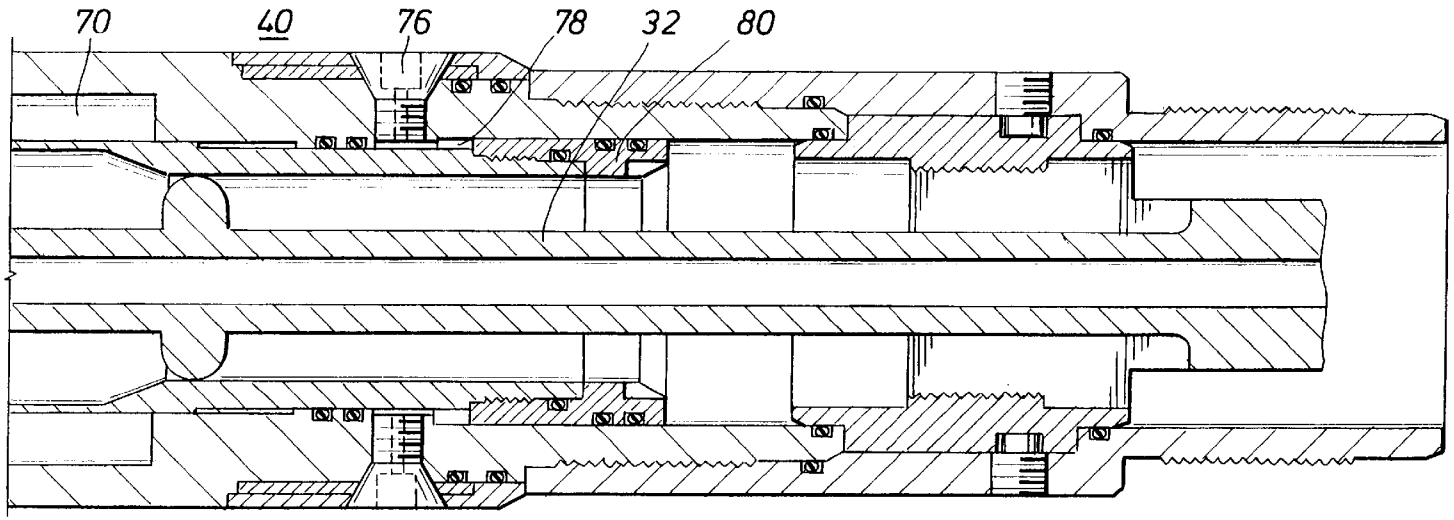
FIG. 3C-U
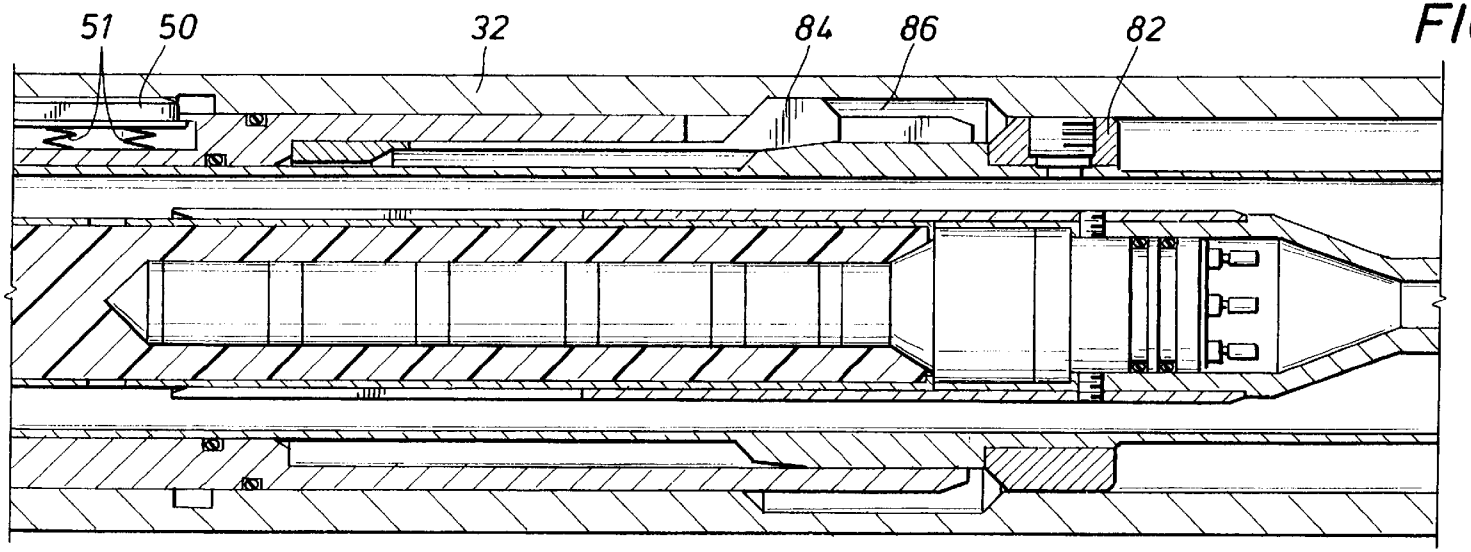

FIG. 3B-M
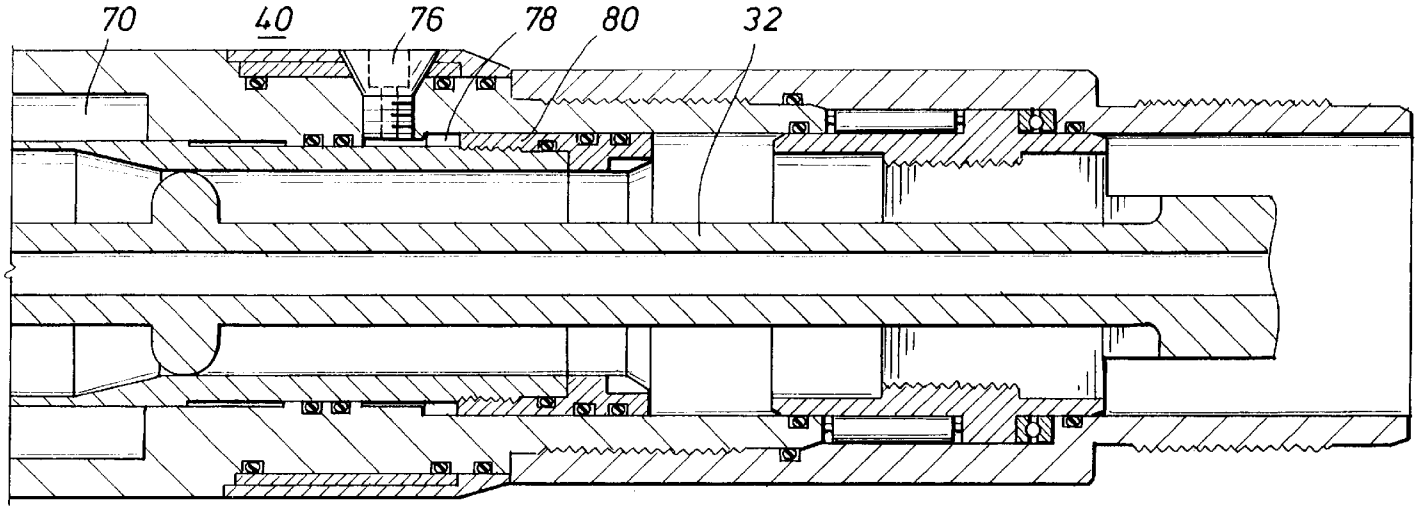
FIG. 3C-M
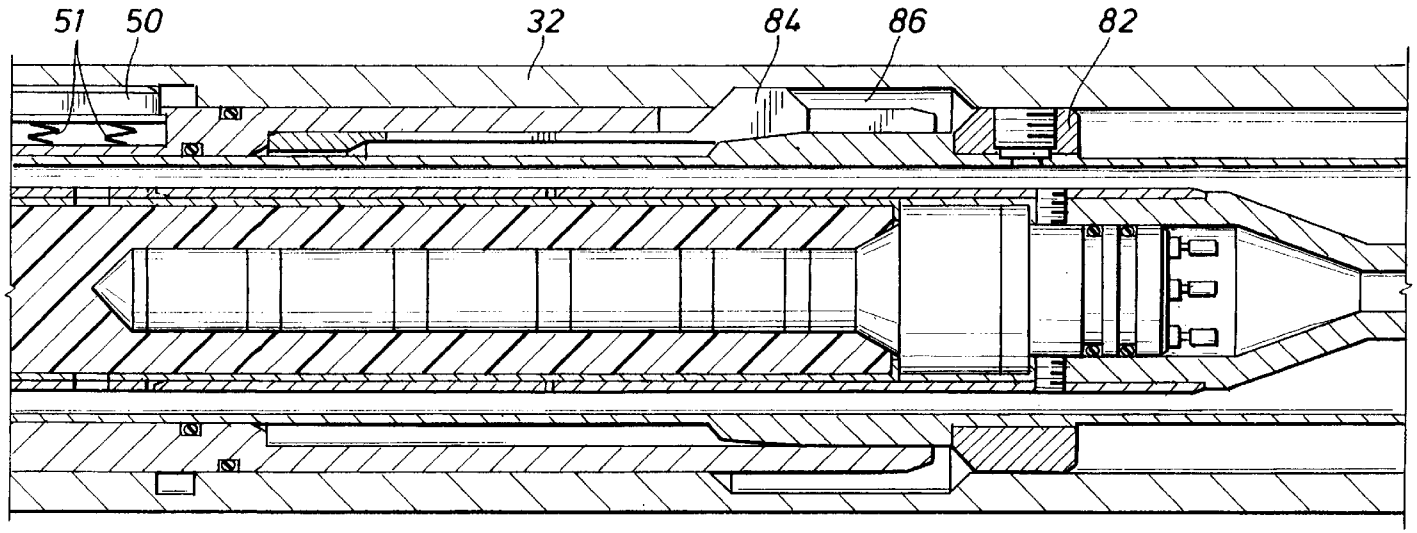

FIG. 3B-L
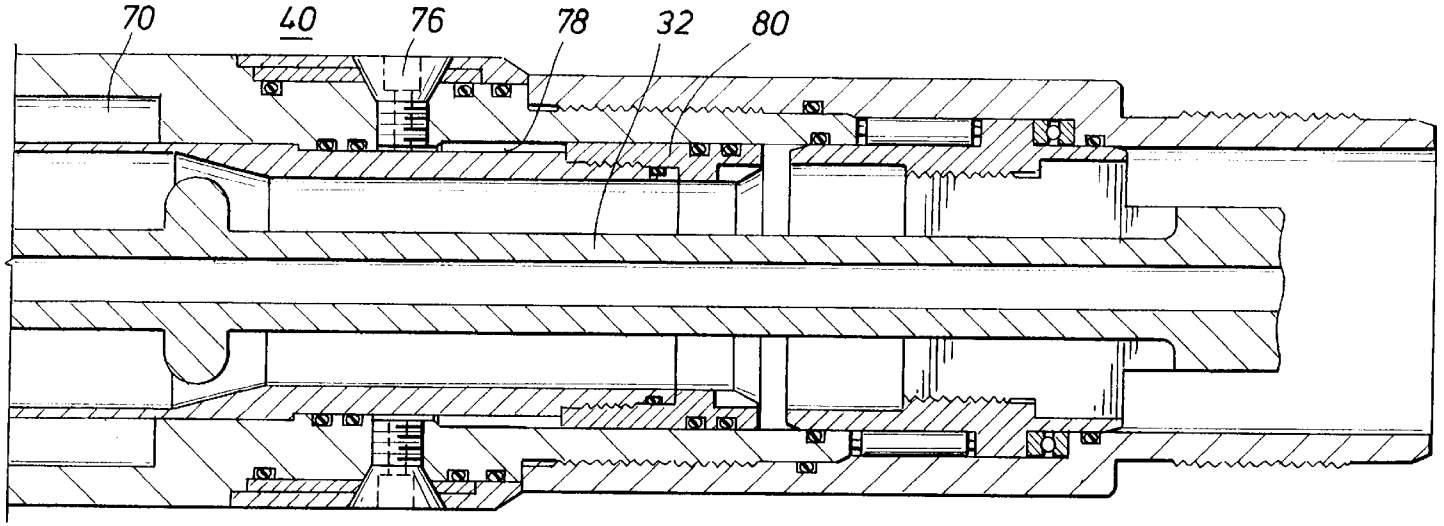
FIG. 3C-L
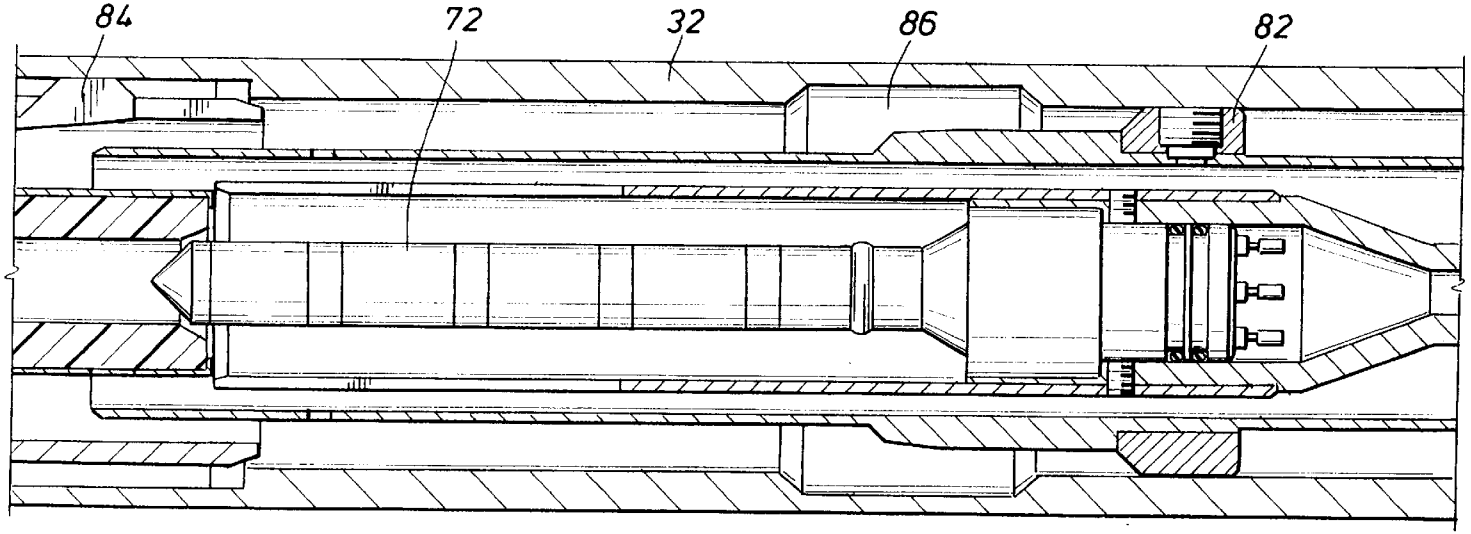

FIG. 3D-U
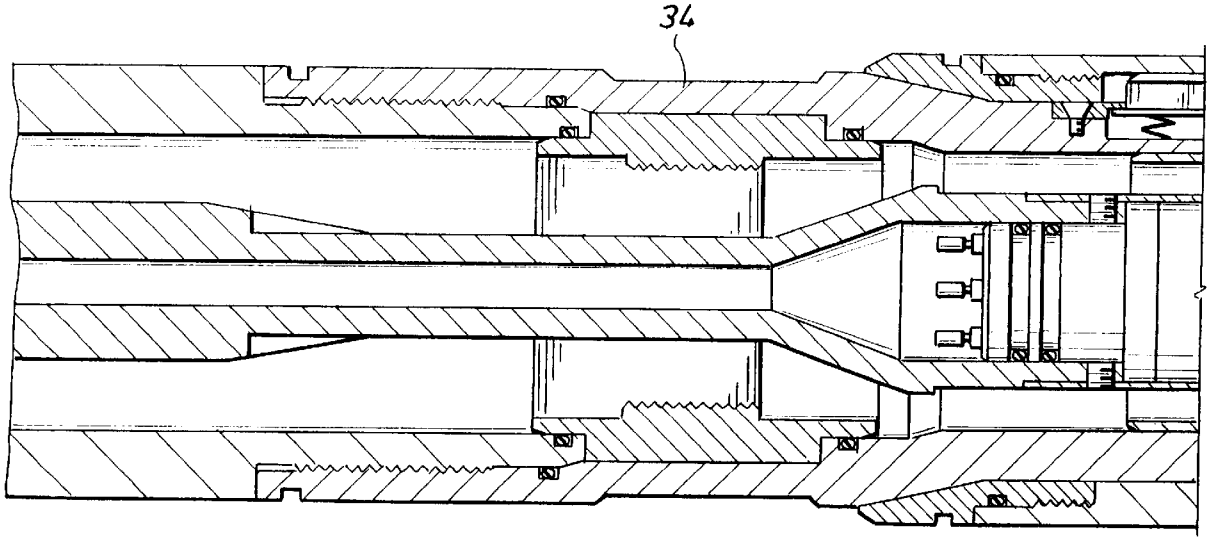
FIG. 3D-M
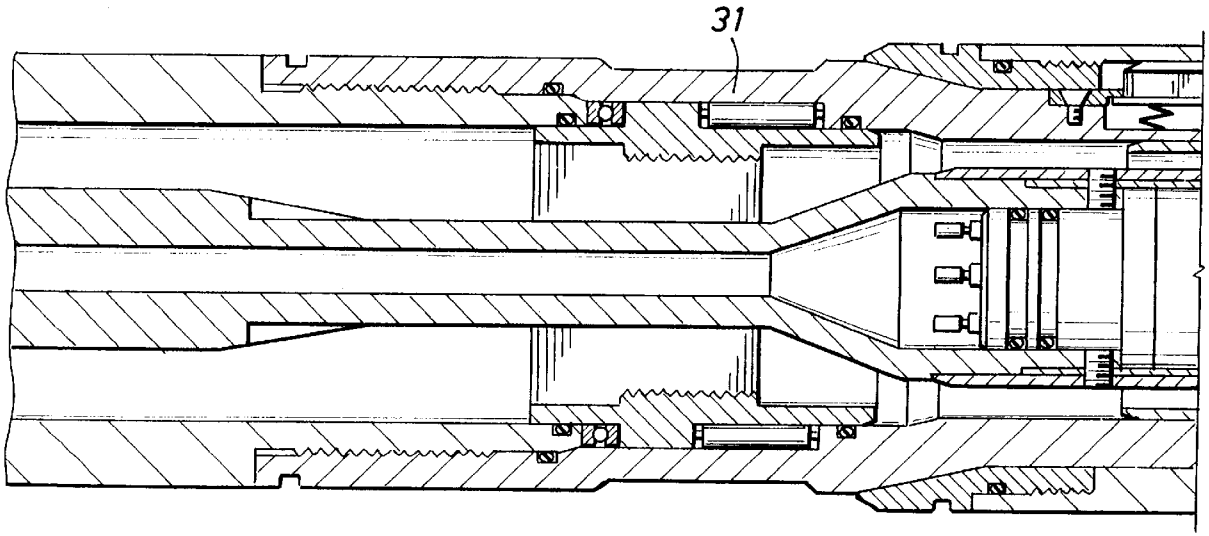

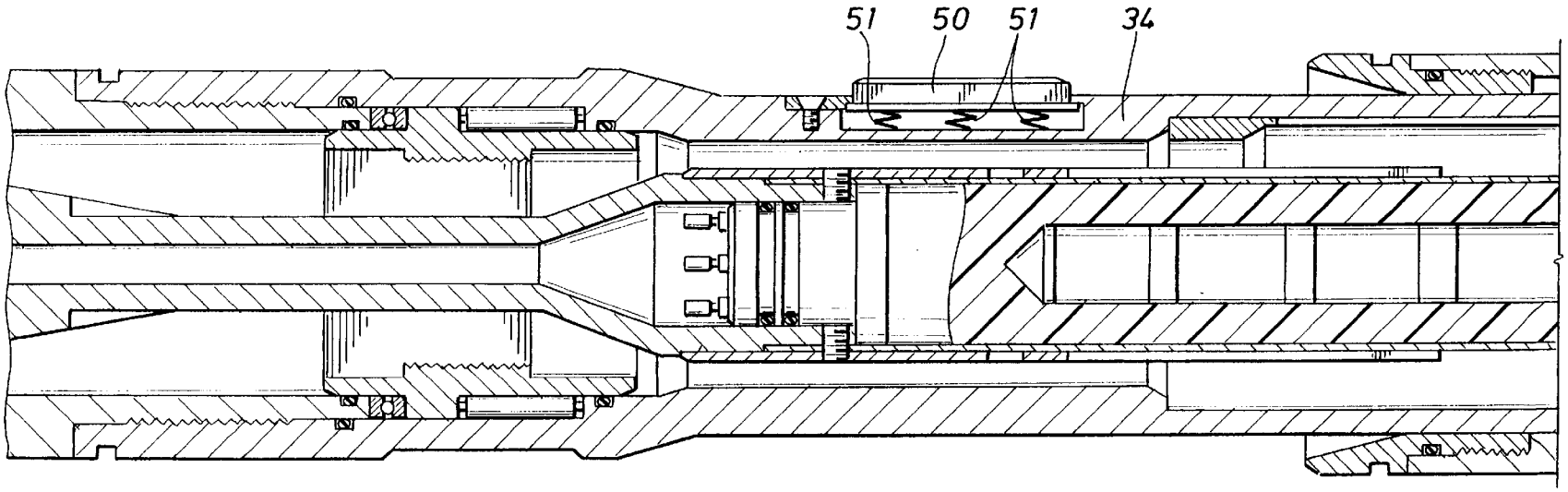
FIG. 3D-L

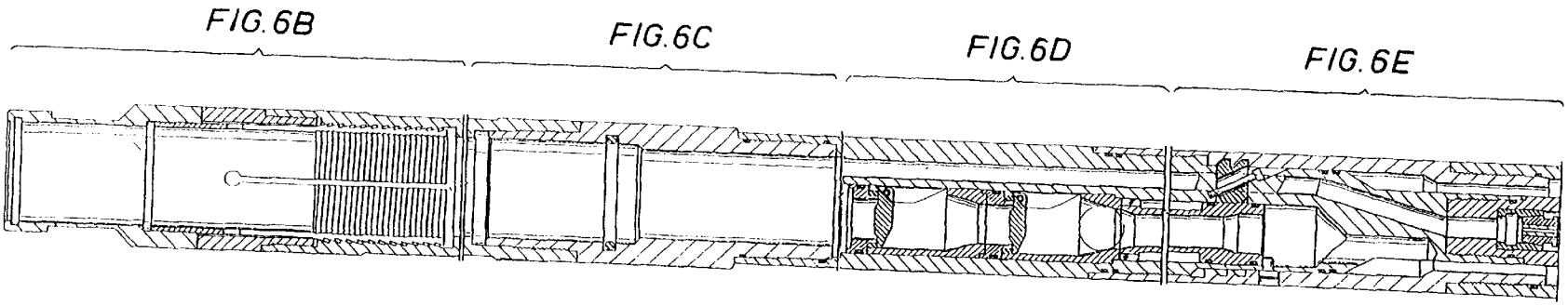
FIG. 6A-1
FIG. 6E
FIG. 6D
FIG. 6C
FIG. 6B
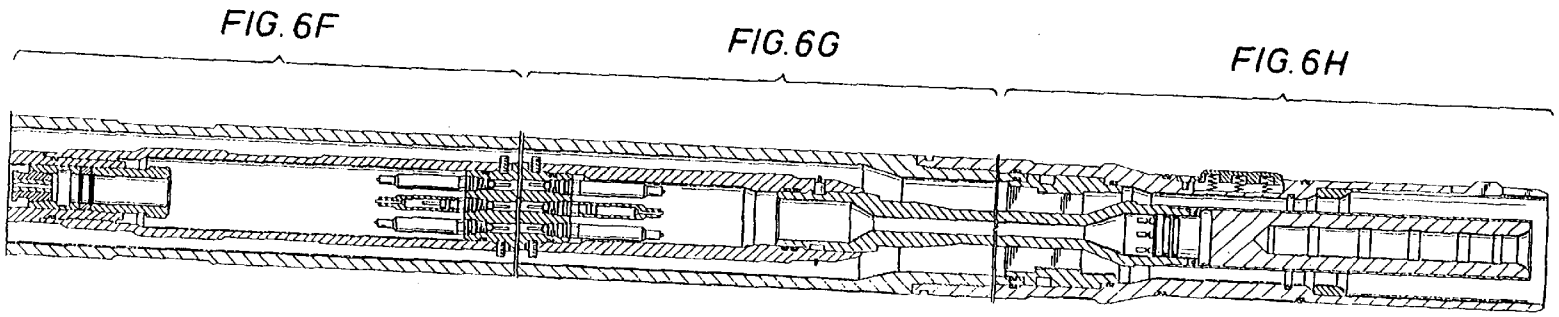
FIG. 6H
FIG. 6G
FIG. 6F
FIG. 6A-2

DEPLOYMENT SYSTEM METHOD AND APPARATUS FOR RUNNING BOTTOMHOLE ASSEMBLIES IN WELLS, PARTICULARLY APPLICABLE TO COILED TUBING OPERATIONS

This application claims benefit to U.S. provisional application Ser. No. 60/037,407, filed Feb. 3, 1997, which is a 371 of PCT/US98/01930, filed Feb. 3, 1998.

FIELD OF THE INVENTION

This invention pertains to methods and apparatus for running bottomhole assemblies in wells, with particular application to running long assembles in live wells associated with coiled tubing operations.

BACKGROUND OF THE INVENTION

This invention represents the marrying and adaptation of several concepts that give the final product a wide range of uses. The ability to function under a wide range of applications affords the instant deployment system and apparatus, including using a multifunctional head with a universal connect/disconnect (UCD) tool, significant speed advantages, especially when using coiled tubing for numerous and differing applications in quick succession. Among the numerous differing applications might be coiled tubing drilling, coiled tubing directional drilling and coiled tubing perforating. The system and apparatus is particularly applicable for all operations performed in whole or in part in a live well using long tools. The system and apparatus might be used for running out of a live well even if running in were performed in a dead well. The system has particular application for sour wells as the system significantly permits making and breaking joints using remote control, largely "hands free".

Components of a multifunctional head system that can advantageously render its use universal include a fatigue resistant, high strength coiled tubing connector tool, a wireline anchor, an electrical bulkhead, a release tool and check valves, all combined with a rotationally insensitive, "hands free" deployment system that is fast to connect and disconnect. Such a multifunctional head system can offer a single coiled tubing head for use with fishing operations, drilling operations (with and without wireline), electric logging operations, perforating and simple circulating procedures. Field trials indicate that this invention can save significant time during coiled tubing drilling operations. While it takes several hours to connect a coiled tubing head, with the instant multifunctional head this operation may only be required once per job, not the normal 3 to 5 times.

There are connector tools available commercially that can connect a bottomhole assembly (BHA) to a string of coiled tubing. There are also separate tools for anchoring wireline, for providing means of disconnecting from the coil, for providing check valve functions and for providing tool connections. There are, however, to our knowledge no tools available that purport to combine these functions in a universal coiled tubing head. Existing combinations of presently commercially available tools can only be effected and used in narrowly constrained conditions.

The present invention, thus, solves one problem of having to use different coiled tubing heads for each different operation to be carried out.

This is particularly beneficial in a typical coiled tubing drilling operation where the sequence of operations would typically be:

Pull a plug
Drill out the shoe using a non-directional drilling string
Drill a directional hole using a directional drill string
Log the hole
(Line the hole)

These operations are traditionally separated by the time consuming work of reheading the coiled tubing. With the present multifunctional head invention these operations could now follow on from each other in a fast, efficient manner, requiring only a quick connector to be broken and remade between runs.

Design for a UCD and its system of deployment was originally developed in conjunction with directional drilling strings. It was subsequently modified for use with perforating guns. Another objective of the developing deployment system and apparatus was to provide a means for quickly connecting and disconnecting tools inside a live wellhead without the need for human, manual intervention. Beneficially, if the riser is open to well fluid and the well is sour, personnel should be able to perform as much as possible of the operation from a remote distance.

Existing systems that have been proposed to achieve this goal are relatively fragile, complicated and expensive. One unique feature of the present invention comprises the use of external pressure to effect tool connection and disconnection. Such use of external pressure has the advantage of permitting the use of simpler downhole components and standard oilfield blow out preventors (BOP's) for surface handling. A second feature of the invention permits making and breaking joints without rotation or rotational alignment.

Two deployment system embodiments have been tested so far. One uses a single external port, referenced to an internal pressure. The second uses two external ports, referencing the differential pressure between them. Either pressure sensitive method of connect/disconnect could be used for a variety of coiled tubing operations.

A preferred embodiment of the deployment apparatus utilizes a standard three ram BOP (Texas Oil Tools). The BOP is modified such that the top ram performs a horizontal position adjustment and a vertical height alignment function. Although in the disclosed preferred embodiment two standard BOP rams have been utilized to create a pressure chamber, it is clear that one ram could be modified to provide the necessary sealing around a connector section and to provide a channel for pressure to the connector device.

Several operations in oil and gas wells require the use of quite long tool strings. Two prime examples are perforating tools and drilling tools, as mentioned above. Whereas traditional handling of long tool strings in live well applications has been performed through the use of long risers, such risers are impractical with the very long tool strings. A solution developed for this problem, commonly referred to as "deployment", involves running shorter modular sections of a BHA tool string into a live wellhead and then connecting the successive sections together.

Various methods of achieving deployment for the very long tool strings have been developed. However, these methods either have failed to allow for a true "hands-free" operation, or have resulted in complex mechanisms. The present invention solves this problem by using pressure external to the connector tool to achieve a "hands free" locking/unlocking operation. The use of pressure has the additional advantage of allowing the use of established wellhead pressure control equipment (BOP's), appropriately modified. The methodology of the present invention permits the use of this trusted standard surface equipment and provides in addition for incorporating a rugged, simple downhole connector tool. The result is a connector system and tool suitable for harsh environments, such as the vibrating, dirty environment associated with drilling.

Prior art deployment systems also appear to involve a further problem that may prevent them from being used for drilling operations. This problem is occasioned by the fact that connections in a drill string must withstand torque; otherwise the drill motor spins rather than the bit!

Anti-rotation devices needed in the connector tools have taken many forms, including splines, keys and castelations. All of these solutions to date have required rotational alignment of the connector tool sections before or during connecting. Rotational alignment is not easy in a coil environment as neither half of the connector can be easily rotated. Rotational alignment during connecting slows down the process and historically requires personnel around the riser during the process, a situation to be minimized in sour well operations. To solve this problem, a novel feature of the present invention is to ignore the objective of achieving a rotational lock as the vertical connection is being made. With the instant system the connection is initially left free to rotate during vertical connection. A rotational lock is triggered subsequently when the tool first experiences a rotational force. One particular method for practicing this system can be achieved through the use of spring loaded keys.

Thus, one aspect of the present invention includes a method for affording an anti-rotational connection that, unlike prior solutions, does not require rotational alignment of two connector tool sections prior to, or during, tool vertical connection. A subsequent anti-rotational connection is achieved by the use of spring loaded keys which spring out into receptor keyways after the quick vertical connection has been made. The connector sections are left free to rotate during make up. Only when exposed to a rotational force subsequently does the made up connector rotate slightly and then lock positively, allowing no further rotation.

In overview, the invention comprises a composite of concepts. An additional concept includes putting not only one but two independent release mechanisms in the connector tool, both able to be used for "hands-free" deployment. Pressure activation affords an effective method for implementing the two independent release mechanisms. A preferred embodiment of the invention includes, thus, two independent pressure activated, biased pistons, one restrained by springs, and the other by shear pins. Each piston can be designed to move at a predetermined pressure, each affording release of the connector sections.

Traditionally, as discussed above, there were limitations on the lengths of perforating guns that could be run on coil, as the guns usually have to be retrieved from a live well. This meant that a lubricator length was required that was at least as long as the guns run, and there was a limit to the length of a riser, or lubricator, that could be accommodated, on both land and offshore operations. As the running of long perforating guns on coiled tubing has become a growing business, an alternative deployment approach developed to deploy these guns in sections. Deployment systems developed for use with perforating gun modules that used downhole connectors that could be connected and disconnected "hands-free" inside a live wellhead, incurred the additional problem that they had no suitable contingency plan to allow for a connector failure, short of killing the well. In other words, if, during retrieval of perforating guns, one of the connectors were to fail to disconnect, there is no other safe course of action other than killing the well. Even then it is not possible to maintain two barriers in the well (standard oilfield requirement) as it is not possible to strip the guns and indeed they have no internal pressure barrier.

The present invention solves, in addition to other severe weakness of prior deployment systems, this lack of alternative release procedures in the event of a connector failure. The solution of the present design is to put two independent release mechanisms in the connector. If the primary release mechanism fails, then a second can be activated. The availability of this feature may eventually lead to this kind of system being the only system acceptable for use in some more regulated areas such as the North Sea.

In operation, a blowout preventor (BOP) on the well is replaced, if necessary, with a coiled tubing BOP. A coiled tubing BOP has a height of several feet. A deployment apparatus, which can comprise a modified standard BOP, designed in accordance with the present invention, is attached to the top of the coiled tubing BOP. The deployment apparatus has a height of several feet. Three rams are provided within a preferred embodiment of the deployment apparatus. The lower ram seals against and supports or holds, as with slips or slip teeth, a lower section of the connector tool. A portion of the lower universal connect/disconnect (UCD) section is designed to mate with the slips or slip teeth. A second sealing ram a foot or two higher up, seals against another portion of the UCD. A third ram, a foot or two higher up, operates as modified as a vertical height locating and horizontal position adjusting means.

Above the deployment apparatus is situated a gate valve. The gate valve can be a standard gate valve. A BOP modified to become a deployment apparatus provides for attachment to apparatus such as a gate valve. The gate valve occupies a foot or two of height. The gate valve is adapted to receive and sealingly mate with a pressure vessel frequently termed a "riser" or a "lubricator". This can be a standard riser or lubricator. The riser or lubricator may be about fifty feet (50') in height. Two different risers are used typically in a coiled tubing deployment system. The first riser is a wireline riser. The second riser is a coiled tubing riser. The wireline riser has a stuffing box at its top end to sealingly mate with a wireline coming out of the top of the riser. The coiled tubing riser has a stuffing box at its top designed to sealingly mate with coil tubing coming out of the top of the riser. It is not necessary to use a wireline riser. A coiled tubing riser can suffice.

BHA tools can be deployed in modular fashion for running with coiled tubing using the above coiled tubing BOP, deployment apparatus, gate valve and risers, as follows. The coiled tubing BOP, the deployment apparatus and the gate valve are installed. The gate valve is initially closed, forming a barrier at the surface against well fluid. (The coiled tubing BOP offers another barrier against well fluid at the surface.) The UCD has an upper section and a lower section, designed to be vertically and rotationally mated and unmated, or made up and broken. A wireline is connected to an upper UCD section with the wireline running through the stuffing box on the top of the wireline riser. The BHA to be run is broken down into modular lengths, such as thirty foot (30') lengths. A lower section of a UCD is screwed into, or made up into, the top of each module. An upper section of a UCD is screwed into, or made up into, the bottom of each modular tool portion, (save and except the lowest modular tool portion.)

The lowest modular tool portion, having a lower section of a UCD affixed to its top, is made up with the upper section of a UCD connected to the wireline. The modular tool, and wireline are then pulled into the wireline riser. The wireline riser is raised and installed over the gate valve. The gate valve is opened and the modular tool section is lowered via the wireline through the deployment apparatus and coiled tubing BOP. An upper vertical locating ram of the deployment apparatus is closed and the tool is pulled up until a shoulder of the lower UCD section attached to the tool module rests against a shoulder of the vertically locating deployment ram. The lower sealing slip ram and upper sealing ram are then closed about the lower UCD section. The rams both close around predesigned portions of the vertically located UCD section. Pressure is applied to an annular chamber defined in the deployment apparatus between the sealing rams. The vertical connection between the lower UCD section attached to the tool module and the upper UCD section attached to the wireline is broken by means of the pressure. Pressure in the chamber defined between the two deployment sealing rams causes a piston and dog to shift within the UCD. The upper vertical locating ram is relaxed. The wireline with its attached upper UCD section is raised into the wireline riser. The gate valve is closed. The wireline riser is disconnected from the gate valve and returned to pick up a second tool module. The wireline riser is again reinstalled on top of the gate valve with the second tool module. This time the riser contains the wireline with its attached upper UCD section mated to a lower UCD section attached to the top of the second modular unit of the BHA. The second modular BHA unit is attached, as discussed above, at its bottom to an upper UCD section. Upon mating of the riser with the gate valve, the gate valve is opened and the second modular tool unit is lowered. The second unit with its upper UCD section attached to its bottom portion is lowered to rest upon a shoulder of the lower UCD section attached to the upper portion of the initial tool module, the lower section being held in the slip and sealing rams. With the upper and lower UCD sections vertically aligned or actually mated, the pressure is bled off that has overcome and moved a spring biased piston in the UCD. When the pressure is released, the spring biased piston returns to its initial position and a dog attached to the piston forces a collett mechanism in the upper UCD section into a mating detent mechanism of the bottom UCD section. Thereby, the upper and lower UCD sections are vertically united. The union is, at this point, independent of the angular rotation of either UCD section, since the detent of the bottom section is circular. The deployment apparatus rams are now released and the first and second tool modules are lowered such that the lower UCD section attached to the top of the second tool module is in the deployment apparatus. The vertical height ram is closed, and the lower tool section is pulled upwardly until its vertical height is adjusted. The sealing and slip rams are now closed around portions of the lower UCD section. Pressure is applied, as above, to move the piston and dog and permit a disconnect of the upper UCD section connected to the wireline from the lower UCD section affixed to the top of the tool string. (The pressure moves the piston and dog to a position where the collett can free itself, with a suitable pull, from its mating detent mechanism.) The vertical alignment ram is relaxed, and the wireline and upper UCD section are pulled into the wireline riser. The gate valve is shut. The wireline riser is unmated from the gate valve and returned to the ground to pick up a third tool module, it also having a lower UCD section affixed to its top and an upper UCD section affixed to its bottom. The procedure is continued until the time comes to connect the upper tool module to the coiled tubing unit. At this point the coiled tubing riser, usually only a few feet high, is deployed in place of the wireline riser. Using the coil tubing to function as the wireline, the procedure to affix the last tool module to the coiled tubing head is similar to the above, the bottom end of the coiled tubing being connected to an upper UCD section. The coiled tubing riser will remain mated with the gate valve during tool operation downhole.

One feature of the UCD is that it makes and unmakes by virtue of an external pressure triggering a biased piston mechanism. Increasing pressure in a chamber between two sealing rams within a deployment apparatus increases pressure in a chamber on one side of the piston. When the pressure is increased sufficiently, the piston overcomes both its bias as well as any opposing fluid pressure and moves. The translation of the piston in its chamber moves with it a dog. Movement of the dog permits a collet to unset and release from a detent. The collet advantageously forms a portion of an upper UCD section and the detent advantageously forms a portion a lower UCD section. Movement of the piston back lodges the collet, if in place, in the detent by means of the dog.

Interior sections of the upper and lower UCD sections preferably contain mating means so as to form interior pressure seals as the upper and lower sections are mated.

The UCD sections are preferably designed to mate the collets into the detent without reference to relative axial rotation between the sections. Further means are provided such that upon receipt of an initial rotational torque by the UCD tool, keys fixing the relative rotational location of the lower section to the upper section lock into place so that the mated UCD can now transmit rotational torque.

Ports may be provided through the outer wall of the lower UCD section such that pressure in the deployment apparatus chamber defined between two deployment sealing rams can be transmitted to an interior chamber around the piston.

Another feature of the invention includes use of a pair of external pressure ports to develop pressure differentials to release a tool connection. The tool preferably includes two independent pressure triggered release mechanisms in it.

SUMMARY OF INVENTION

The invention includes deployment apparatus for running tools in a well. A deployment BOP is provided having at least one sealing ram. A chamber is defined between ram(s) sealing surfaces. The chamber has a port for communicating fluid. A vertical position element is attached to the deployment BOP and a slip is also attached to the deployment BOP. Preferably, the vertical positioning element and the slip are associated with rams located within the BOP. Also preferably a ram within the BOP includes a horizontal position adjusting element. A gate valve may be attached to the top of the deployment BOP and a coiled tubing BOP attached to the bottom of the deployment BOP. A riser, either wireline or coiled tubing, is typically attached to the top of the gate valve. In a preferred embodiment, the deployment BOP has three rams. A lower ram has a slip associated with the ram. A sealing surface is located on the ram above the slip. The second ram includes a sealing surface. The third or upper ram includes the vertical positioning element and the horizontal position adjusting element.

The invention also includes a method for deploying tools in a live well comprising the steps of externally pressuring at least a portion of a first section of a connector tool in a pressure chamber at the surface of the well, the step of mating a second section of the connector tool with the first section longitudinally and the step of releasing the external pressure. In preferred embodiments, the external pressuring causes the overcoming of a force biasing a latch element of a section, and the releasing includes releasing to longitudinally latch the second section with the first section. The method preferably includes rotationally aligning the first and second sections after longitudinally mating the sections.

The invention includes a method for deploying tools that comprises separating longitudinally a second section from a first section as well as mating the two sections.

The invention includes a connecting device for well tubing and/or well tools that comprises a first section and a second section structured in coordination to longitudinally mate over a continuous range of relative rotational orientations. The sections have in combination coordinating latching elements biased to retain the sections in longitudinal mating orientation. At least one piston is movable in a section in response to pressure wherein movement of the piston operates to overcome the bias. The first section and the second section are adapted to attach to well tool subs. Preferably the connecting device includes one section having a spring biased key and the other section having a coordinating detent such that in at least one relative rotational alignment the key seats on the detent.

The invention also includes a multi-purpose coiled tubing head for use in running tools with coiled tubing downhole in a well. The multi-purpose coiled tubing head includes a coiled tubing connector tool, a wireline anchor attached to the coiled tubing connector tool, an electrical bulkhead attached to the coiled tubing connector tool, a release tool attached to the coiled tubing connector tool, check valves attached to the coiled tubing connector tool and a tool connector attached to the coiled tubing connector tool. A preferred order for attaching the units in and to the connector tool is disclosed but is not necessary.

BRIEF DESCRIPTION OF DRAWING

The invention will be better understood and objects other than set forth above will become apparent when consideration is given to the following detailed description thereof. Such description makes reference to the annexed drawings wherein:

FIGS. 3A through 3D illustrate one embodiment of a connector tool, FIGS. 3B through 3D being enlarged illustrations of 3A.

FIGS. 6A through 6H illustrate a multi-functional coiled tubing head, FIGS. 6B through 6H illustrating 6A in enlarged portions.

DESCRIPTION OF PREFERRED EMBODIMENTS

In the following discussion, when the term "deployment BOP" is used this term is used to refer to a unit or element of a deployment apparatus comprising in particular a pressure chamber. Preferably a deployment BOP is formed from a modified standard BOP that can be bought, such as from Texas Oil Tool. Standard BOPs come with several ram options. A standard BOP will most likely have to be modified in order to function as a "deployment BOP" in accordance with the instant invention. However, one advantage of the invention is the ability to modify a standard and trusted BOP to function as a "deployment BOP".

A "deployment BOP" does not perform a standard BOP function. Rather, it is to be expected that the "deployment BOP" will be associated with a standard BOP performing a standard BOP function, such as a coiled tubing BOP.

One or more rams of a standard BOP can be easily modified to provide a chamber for receiving and disbursing pressure to the connector tool located within the ram's or rams' sealing surfaces. The standard BOP may come with a port already well situated in fluid communication with the chamber as defined. A standard BOP also offers the opportunity to modify a ram to form it into a vertical height positioning element. A standard BOP further offers the ability to associate a slip device with a ram. A likely modification would be to invert a lower standard slip ram so that the slip is below the sealing surface. The ram of the standard BOP modified to function as a vertical height positioning element can further be modified to also function as a horizontal location adjusting element.

Notwithstanding the advantages of modifying a standard BOP, it should be recognized that a unit referred to as a "deployment BOP" could be a unit specially made or adapted, including a chamber from another source, as long as the unit is capable of holding the required high pressure, is of the appropriate length and is capable of sealing attachment to other apparatus or chambers above and below. It should be emphasized again that a "deployment BOP" does not function as a BOP, but functions predominately as providing a pressure chamber and is cost effectively created by modifying a standard BOP available in the marketplace.

Figure 1B:
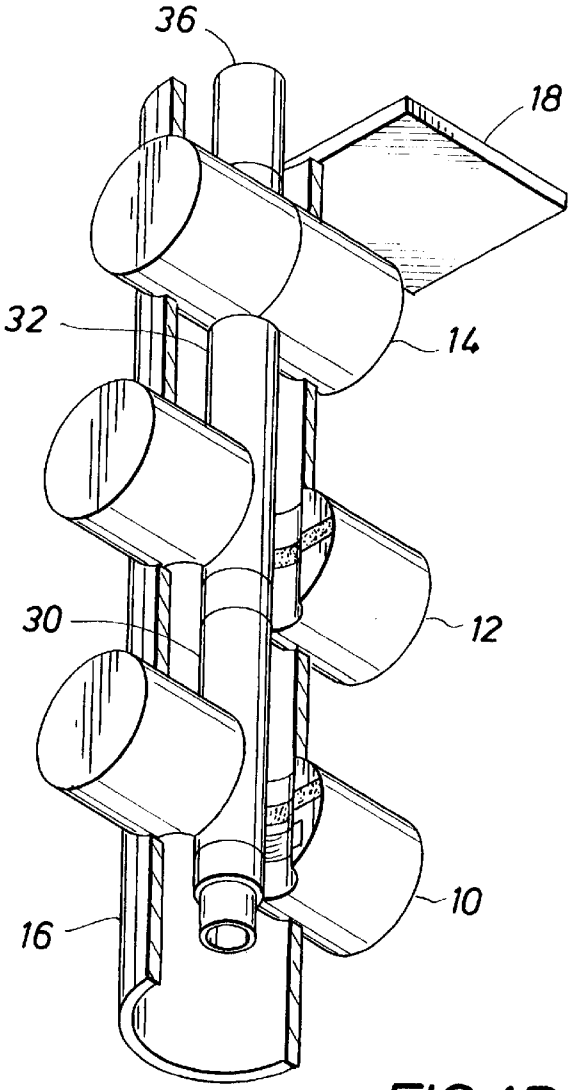
FIGS. 1A through 1L illustratively represent deployment apparatus and method together with a connector tool in various positions.
Figure 1A:
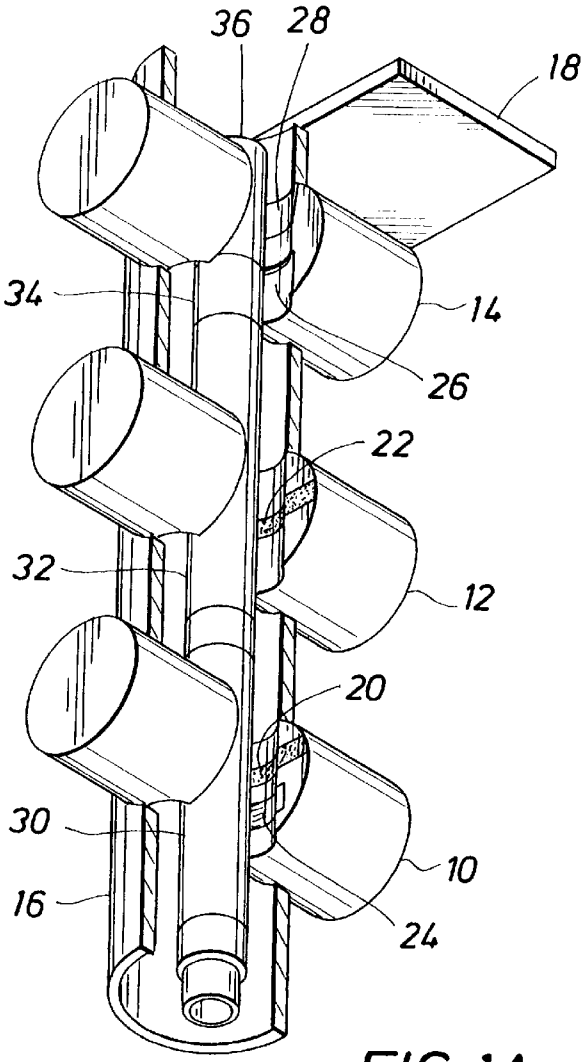

FIGS. 1A through 1L illustrate deployment apparatus of the present invention together with a connector tool. FIG. 1A illustrates the relevant components in combination. The illustration is in partial cut away as a illustrative device. Unit 16 is an element referred to as a "deployment BOP." Preferably unit 16, together with rams 10, 12 and 14, are adapted from a standard off-the-shelf blowout preventer (BOP) such as of the type that may be purchased from Texas Oil Tools. Deployment BOP 16 is illustrated as being of the type having three rams, rams 10, 12 and 14. A three-ram BOP is easily adaptable to the present invention, but it is not required.

One of skill in the art would realize that a single ram could be adapted to provide the sealing surfaces to define the requisite pressure chamber.

A connector tool consisting of units 30, 32 and 34 is illustrated residing within deployment BOP 16. Some bottomhole assembly or downhole tool module would normally be connected to the lower end or bottom of section 30. That tool or module is not shown. Usually such tool or module would be made up to section 30 by screwing upon the end of section 30.

Section 30 and section 32 comprise a first and lower section of the connector tool. Section 34 comprises a mating upper second section of the connector tool. Section 34 is shown attached at its top side to tool unit or module or sub 36. Again, unit 36 is likely connected to unit 34 by screwing. Section 34 of the connector tool connects and disconnects with the joined lower section comprised of units 30 and 32 in a manner to be described. The lower section of the connector tool is illustrated as comprising two units because in one embodiment of the invention a secondary release mechanism permits the lower portion of the first section 30 to separate from the upper portion of the first section 32.

The connector tool in FIG. 1A is illustrated as residing within the deployment BOP with all three rams open. In the open position, ram 10 is illustrated as having sealing surface 20 above slip surface 24. In a preferred embodiment, ram 10 is actually an upside down or inverted ram of a standard BOP. In a standard BOP sealing surface 20 would be below slip surface 24 in the vertical direction.

Ram 12 is shown as containing sealing surface 22. Ram 14 has been adapted to provide a vertical height positioning means 26 on its lower inside surface and a horizontal location positioning means 28 on its upper inside surface. Surface 26 on the lower portion of ram 14 is designed to mate with a shoulder 35 of upper section 34 of the connecting tool. Such shoulder is illustrated as shoulder 35 in FIG. 2A. Upper interior surface 28 of ram 14 is illustrated as an inverted cone, or a cone with its apex pointing downward. Such conical surface 28 will guide the lower end of any tool being introduced into the top of deployment BOP 16 such that that tool becomes horizontally oriented or positioned within deployment BOP 16. Such a horizontal location positioning surface is useful in order to facilitate stabbing or mating an upper section of a connecting tool down and into a lower section of a connecting tool already affixed within deployment BOP 16, as by slip 24 of ram 10.

A gate valve 18 is illustrated on top of deployment BOP 16. Standard BOPs are designed to attach to other chambered units at both ends, such as a standard gate valve. Unit 18 merely illustrates such a standard gate valve that can be purchased and readily attached to the top of a standard BOP. A riser, either a wireline riser or a coiled tubing riser, would be attached to the top of gate valve 18. Such a riser is known in the art and not illustrated in the drawings. Such a riser and its means for attachment are known in the art.

After the lowering of a connector tool into the deployment BOP, through the riser and gate valve above, FIG. 1B illustrates that upper ram 14 would then close. The connector tool could then be pulled upward by the wireline or the coiled tubing such that shoulder 35 of the upper section of the connector tool is vertically aligned and positioned by shoulder 26 of ram 14 as ram 14 has closed around the connector tool, as illustrated in FIG. 1B.

Subsequent to vertical alignment of the connector tool within the deployment BOP, lower ram 10 would then be closed. Closing lower ram 10 positions sealing surface 20 around a portion of a lower section of the connector tool and grabs or secures another lower portion of the connector tool within slips 24.

Figure 1D:
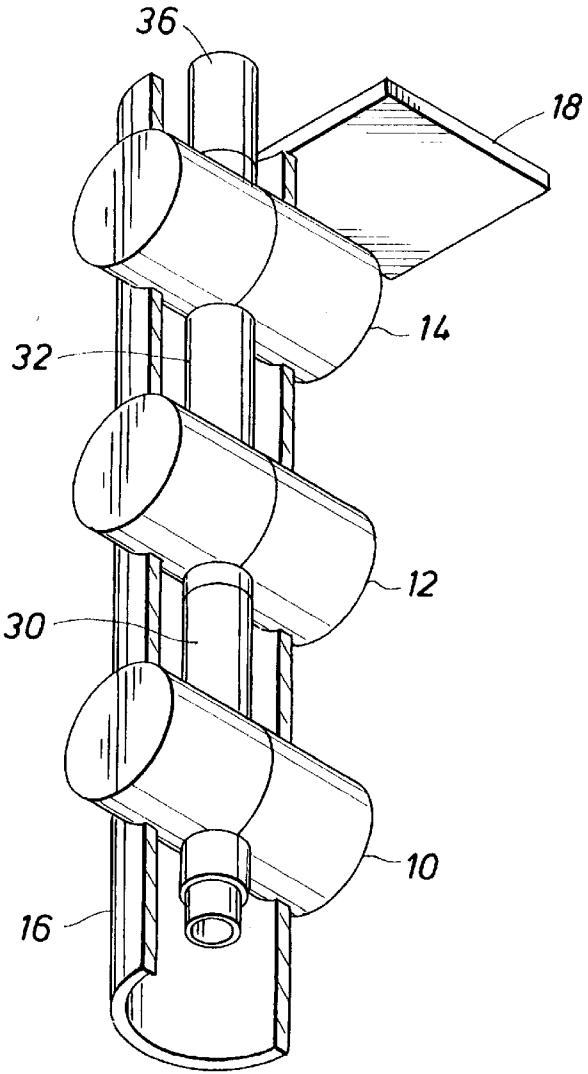
Figure 1C:
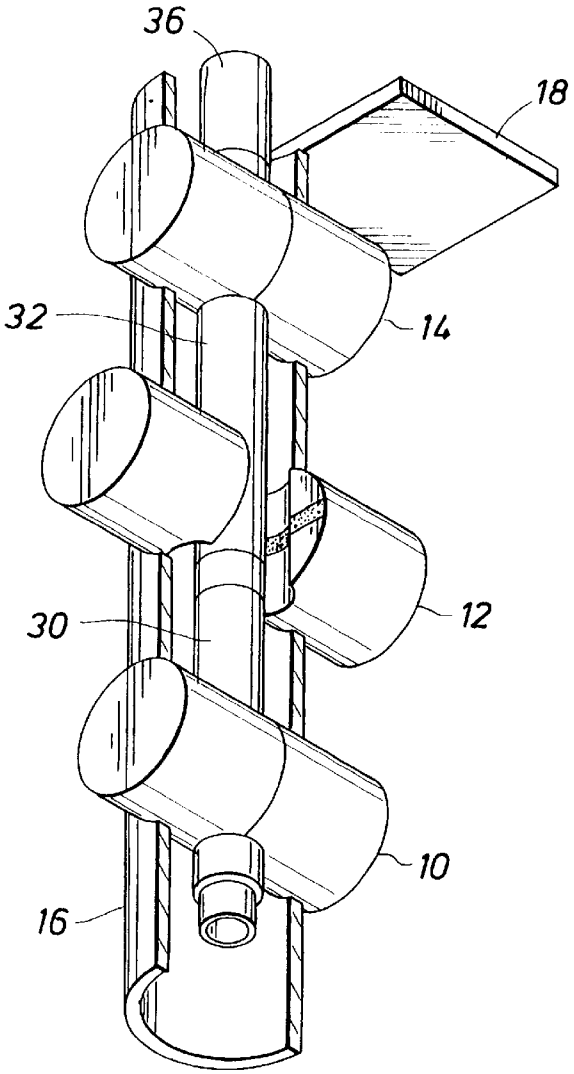

FIG. 1D illustrates closing ram 12 with sealing surface 22 around a further portion of a lower section of the connector tool. Closing rams 10 and 12 with their sealing portions 20 and 22, respectively, defines a pressure chamber 40 of deployment BOP 16, area 40 as illustrated in FIG. 1E. FIG. 1E also illustrates pressure chamber 40 pressured up through the supply of a pressured fluid from outside deployment BOP 16, the port for the supply of such pressured fluid not being shown. Such port is likely standard upon any BOP adapted for use as a deployment BOP. Deployment BOP 16 is preferably attached on its lower side to a wellhead BOP such as a coiled tubing BOP, not illustrated but known in the art.

Figure 1F:
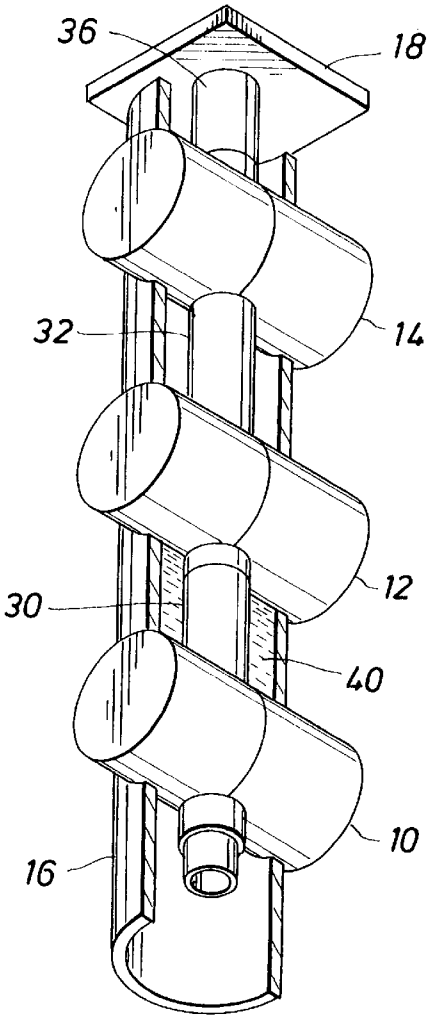
Figure 1E:
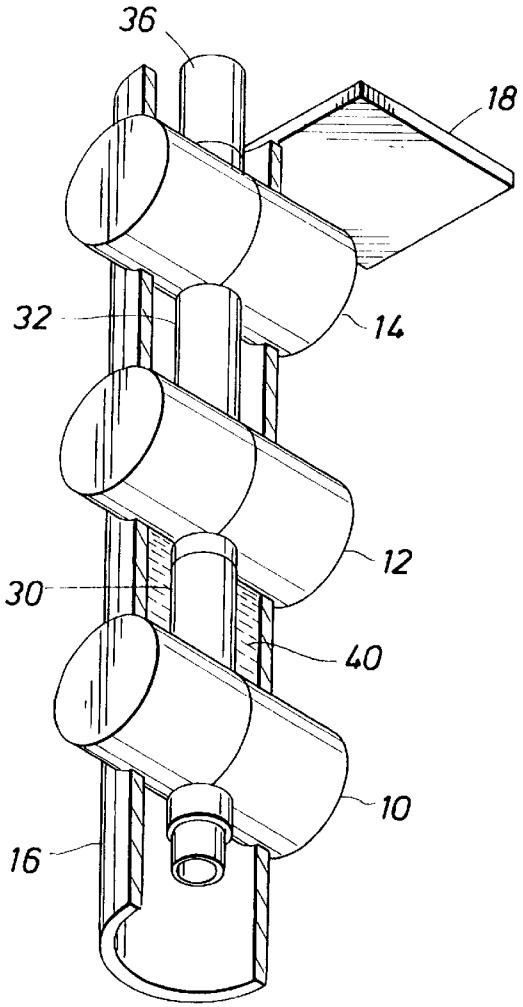
Figure 1H:
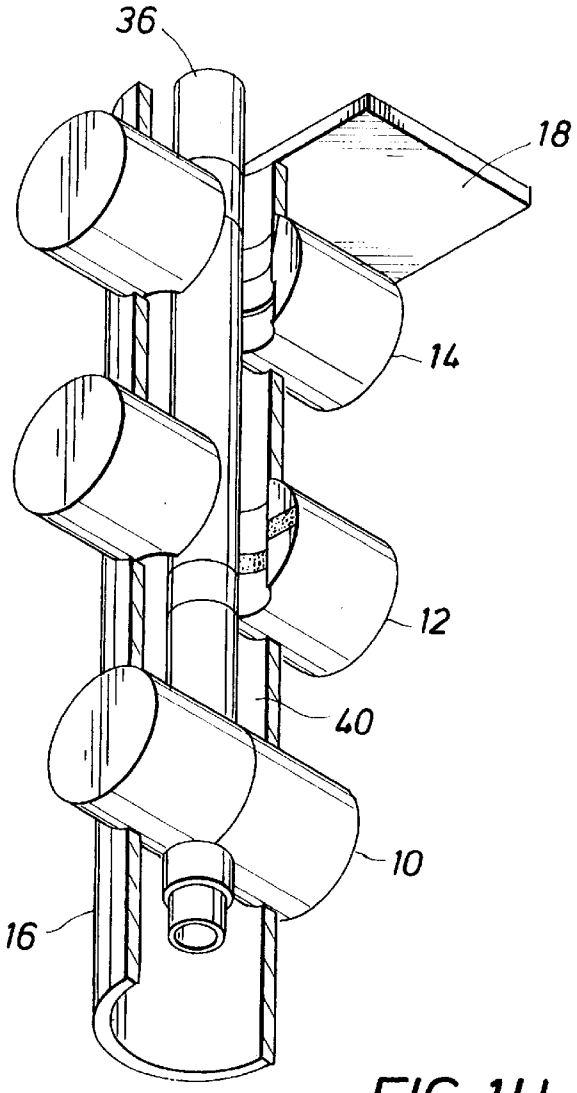

FIG. 1F illustrates that upper section 34 of the connector tool has been removed from the deployment BOP, such removal being made possible by pressuring up chamber 40 in a manner to be discussed in more detail below. Gate valve 18 has now been swung across and seals off the deployment BOP. The deployment BOP is holding the lower section of the connector tool and any tools connected below that lower section, not illustrated, by means of slip 24.

Figure 1G:
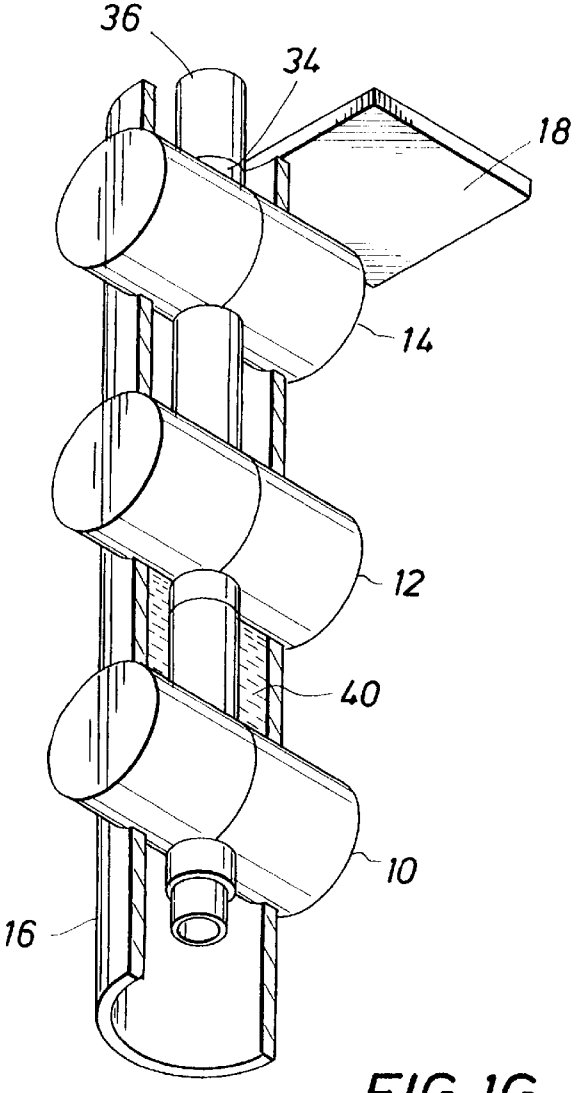
Figure 1I:
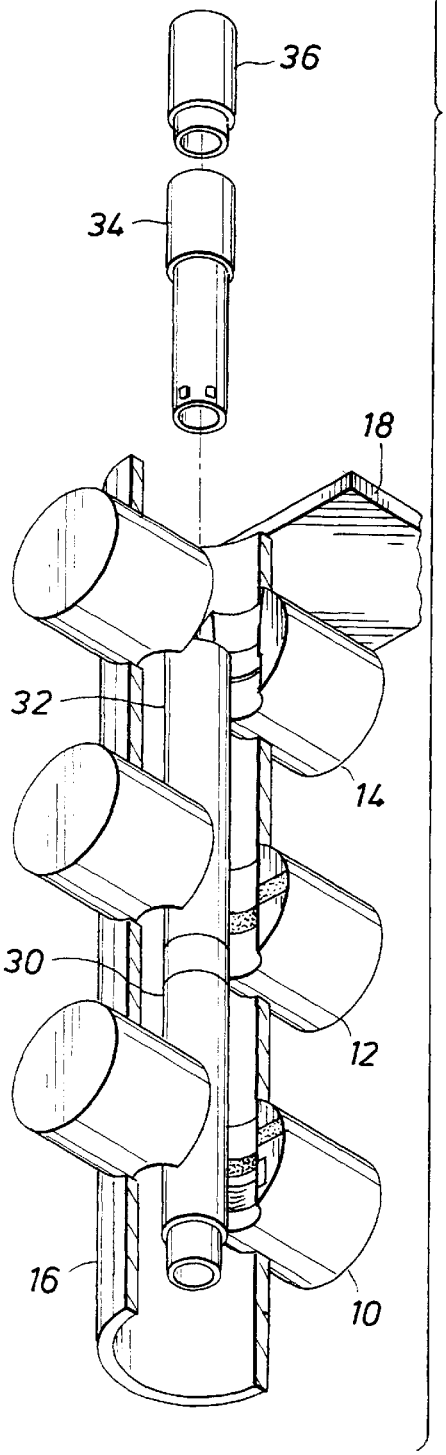

FIG. 1G illustrates gate 18 being opened and presumably new upper section of connector tool 34, connected to unit 36 above it, having been lowered into the lower section 32 of the connector tool. Upper section 34 will be lowered until its weight rests upon a shoulder within the lower section of the connector tool. The upper ram will likely be opened in this process. Pressure chamber 40 is illustrated as pressured up in FIG. 1G. Pressuring up pressure chamber 40 moves a piston within the lower section of the connector tool which opens the latching devices by which the upper section of the connector tool is latched longitudinally or vertically to the lower section of the connector tool. After the upper section of the connector tool is seated, in arbitrary rotational position within the lower section of the connector tool, pressure chamber 40 is opened and the pressure bled off. When pressure section 40 is opened a piston or pistons within the lower section of the connector tool returns or return to a biased position. The return of the piston(s) to its biased position forces a collet, illustrated as collet 60 in FIG. 2A, of the upper section of the connector tool to seat within an annular slot or detent within the lower section of the connector tool. In such manner, the upper section of the connector is longitudinally or vertically latched to the lower section of the connector tool, and latched independently of any particular rotational alignment between the two sections. Subsequent to latching, rams 12 and 14 would likely be opened and the upper section of the connecting tool pulled upward in order to insure that a secure latch has been made. Once the operator is confident that a secure longitudinal or vertical latch has been made between the two units of the connector tool, ram 10 together with slip 24 is opened and the connector tool with its associated bottomhole assembly or downhole tool modules or units is lowered further into the well through the riser above and through the blowout preventer below as well as through the gate valve.

FIG. 11 illustrates in slightly clearer detail the lower section of the connector tool comprising units 30 and 32, the upper section of the connector tool comprising unit 34 and an element or unit 36 that mates with the upper section of the connector tool.

Figure 1J:
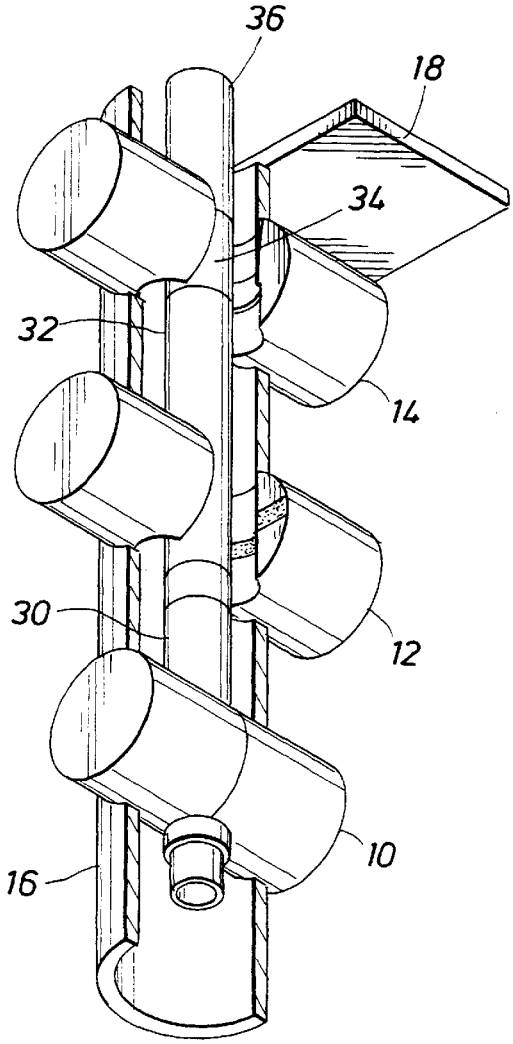
Figure 1L:
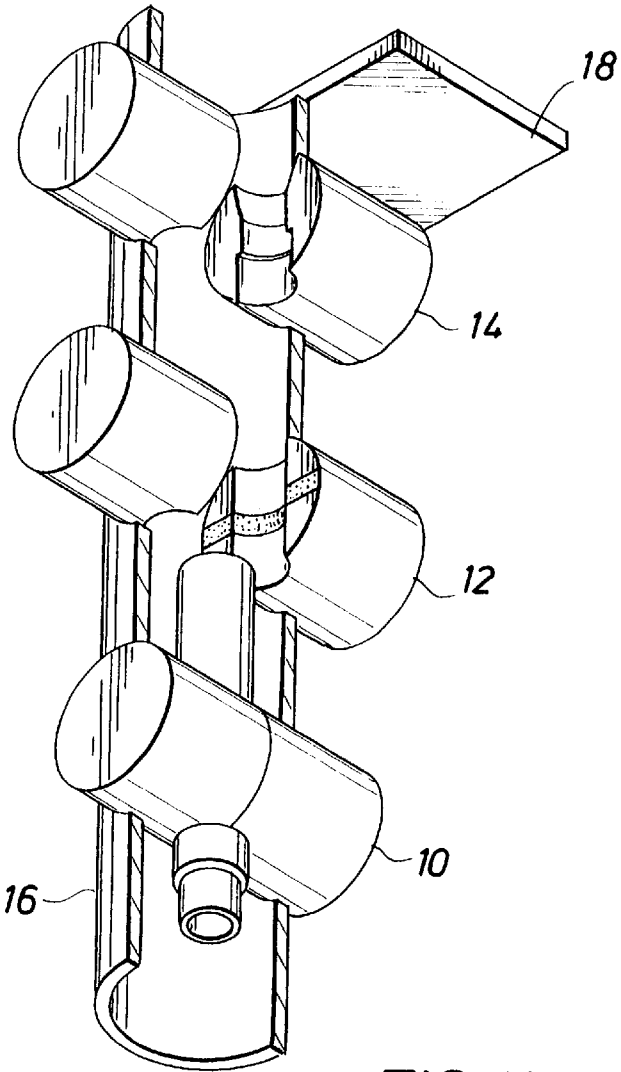
Figure 1K:
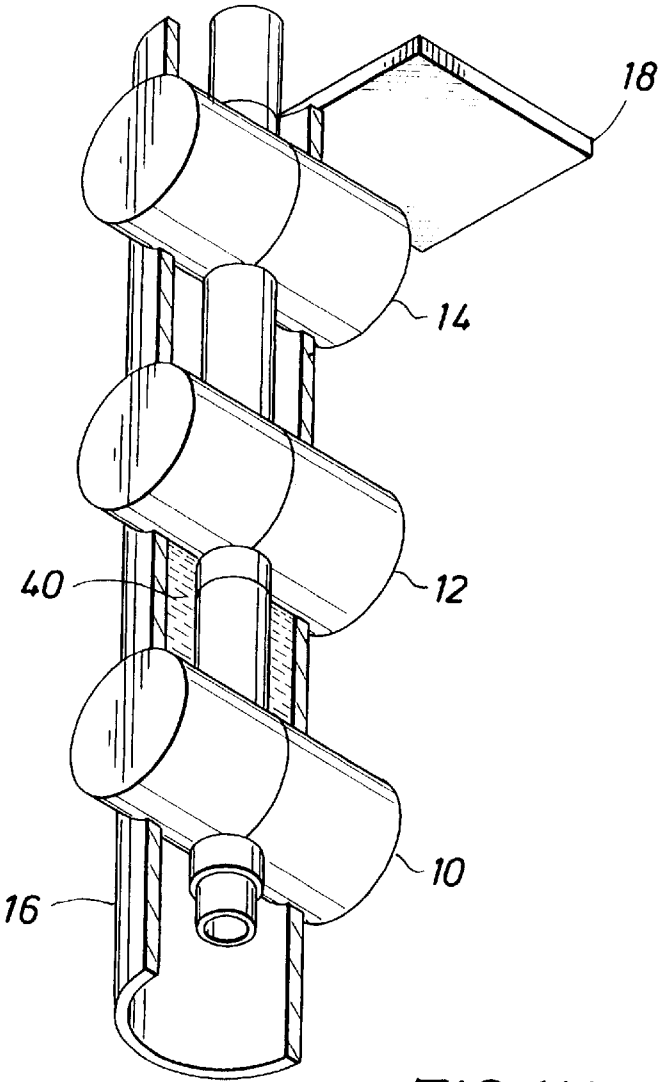

FIGS. 1J, 1K and 1L illustrate a second release device in the lower section of the connector tool. FIG. 1J illustrates the connector tool with upper section 34 connected to lower sections 32 and 30. The connector tool is within the deployment BOP and in fact lower slip and sealing ram 10 is closed about a portion of the lower section of the connector tool. The gate valve is open. FIG. 1K illustrates pressuring up pressure chamber 40 to an exceptionally high pressure. This option would be utilized if pressuring chamber 40 up to a lower pressure did not secure the release of the collet from the detent or secure the release of upper section 34 from lower sections 30 and 32. Upon application of exceptionally high pressure in pressure chamber 40, sections 30 and 32 separate through the movement of a secondary piston within the lower section of the connector tool. FIG. 1L illustrates the connector tool separated not only from upper section 34 but also from the upper part 32 of the lower section. The lower portion 30 of the lower section together with whatever tools and bottomhole assembly is connected underneath it, not illustrated, is shown secured by slip 24 within ram 10 that is closed about lower section 30.

Figure 2A:
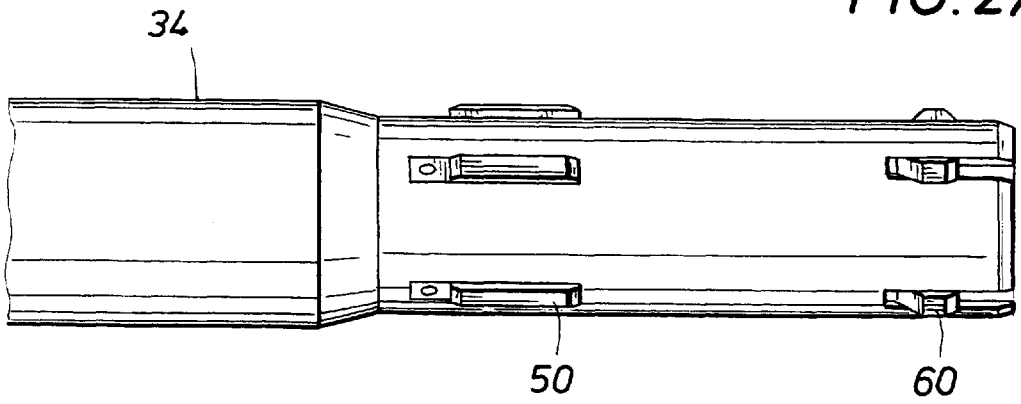
FIGS. 2A through 2C offer an outside view of an upper section of a connector tool, illustrating in particular a spring biased key mechanism utilized to achieve rotational orientation and an annular collet utilized to achieve longitudinal orientation with respect to a lower section of the connector tool.
Figure 2B:
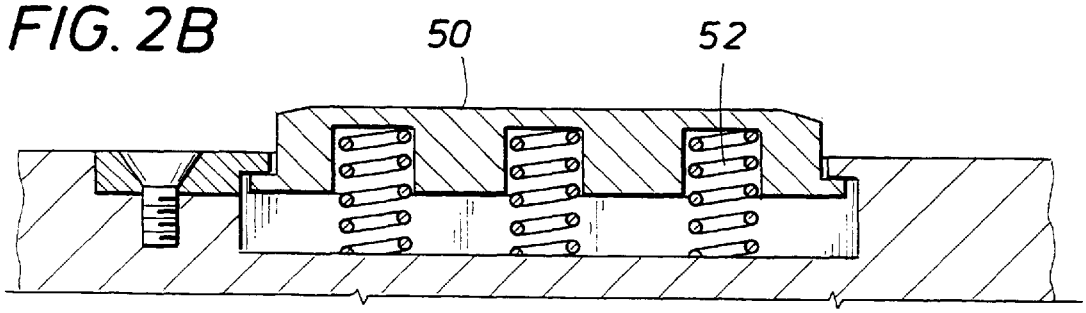
Figure 2C:
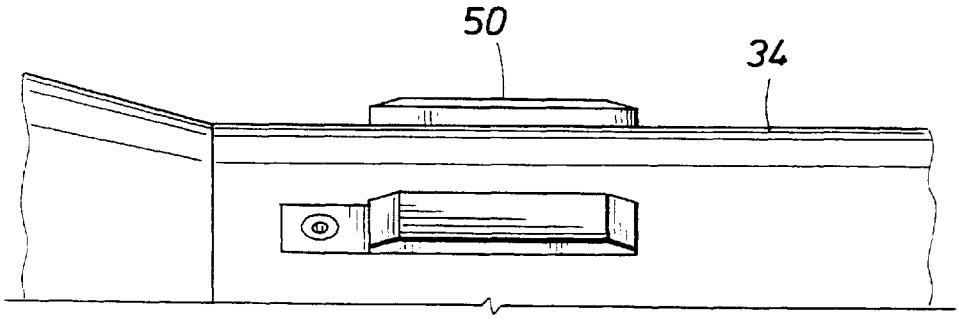

FIGS. 2A through 2C illustrate an upper section of a connector tool. Upper section 34 of the connector tool is shown having spring biased keys 50. FIG. 2B illustrates a partial view of springs 52 biasing key 50 outward. As will be discussed below, a portion of a lower section of the connector tool contains detents into which spring biased keys 50 can extend when upper section 34 hits a particular rotational alignment with the lower section of the connector tool. Collet 60 permits the upper section 32 of the connector tool 34 to be longitudinally or vertically aligned with the lower section independently of any rotational alignment. Subsequent to securing vertical or longitudinal latching with collet 60, torque upon one or the other section tending to rotate one section with respect to the other will bring spring biased keys 50 in alignment with detents in the lower section such that the keys extend into the detents. The two sections are thereafter rotationally aligned.

A short summary of a deployment system method is as follows:

- Run in with wireline or coiled tubing a first section of a tool string to be deployed; run past the locator ram at the top of the deployment BOP unit;
- Close the locator ram and slowly pull the tool string up; the top of the running tool connector should shoulder against the locator ram; this guarantees that the deployment connector is in the correct position;
- Close the lower pipe slip ram (inverted as mentioned above from the standard BOP) and upper pipe ram;
- Set down weight to verify that the slips are holding the connector in position;
- Lock rams in position;
- Pressure up between pipe rams with an air-driven pump to a pressure such as 3,000 psi above well-head pressure;
- Pull to release the connector and observe pressure bleed off between the rams;
- Pull the running tool into the lubricator or riser and close the gate valve above the deployment BOP and bleed off pressure in the riser;
- Load the next section of tool string into the riser and equalize pressure;
- Run tools into the deployed connector; pressure up to 3,000 psi above well-head pressure and make up connection; pressure up to 3,000 psi above well-head pressure and run tools into deployed connector;
- Bleed off pressure between the rams and pull tests to verify connection is made;
- Open all rams and run in hole; repeat the sequence as required to build up tool string;

A similar sequence of operations is carried out when removing tool strings from the well-head and separating modules, as will be understood by those in the art.

FIGS. 3B through 3D illustrate in greater detail the tool illustrated in FIG. 3A. The tool illustrated in FIG. 3A is illustrated in different positions. In the lower illustration of FIG. 3A, the connector tool is not latched vertically or longitudinally. In FIGS. 3A through 3D, "up" is to the left and "down" is to the right.

The embodiment of FIGS. 3A through 3D does not have a second release mechanism. That is, the lower section does not have a second means to separate from itself at exceptionally high pressure.

As illustrated most clearly in FIGS. 3B through 3D, upper section 34 contains means for achieving a wet connect with a portion of the lower section 32 of the connector tool.

Although the deployment BOP is not illustrated in FIGS. 3A through 3D, area 40 comprising the pressure chamber area of the deployment BOP is illustrated. Fluid pressure from pressure chamber 40 is communicated through port 76 into chamber 78 within lower section 32 of the connector tool. The lower drawing illustrates the lower section 32 being pressured via pressure in chamber 40 and through port 76. Piston 80 has moved to its right or pressured-up position within lower section 32. In the lower drawing of FIGS. 3, piston 80 is pressured up by chamber 78 and moved to its far right or lower position. Piston 80 draws dog 82 with it to the right. In this manner, collet 84 of upper section 34 is free to pass into and seat in annular detent area 86 of lower section 32. As illustrated in the middle drawing of FIGS. 3, when collet 84 is seated in detent area 86 of lower section 32, pressure is bled out of port 76 and out of chamber 40. Such bleeding of pressure allows piston 80 to move to the left. Piston 80 is in fact biased to the left by a spring, not illustrated, residing in chamber 70 and urging dog 82 to the left. As dog 82 moves to the left, it biases and holds collet 84 in detent 86 such that upper section 34 can not be pulled longitudinally out of lower section 32. However, collet 84 is free to rotate within detent 86.

Key 50 with chambers 51 for springs 52, not illustrated in FIGS. 3, is connected to section 34 and also slides within a portion of lower section 32. Spring biasing of key 50 permits key 50 to retract inwardly inside of lower section 32. However, when key 50 is presented with an appropriate and mating detent in the surface of lower section 32, springs 52 bias key 50 outward to seat in the detent. When keys 50 have set within their detents, then section 34 is rotationally aligned or rotationally fixed with respect to lower section 32.

FIGS. 4A through 4E illustrate a different embodiment of a connector tool, this embodiment having dual ports and an alternate means for setting the latches which fix longitudinal or vertical alignment of the two sections of the connector tool. Furthermore, the embodiment of FIG. 4 illustrates the two portions of the lower section of the conductor tool that may also be separated under extremely high pressure. In the drawings, "up" is to the left and "down" is to the right.

Figure 4A:
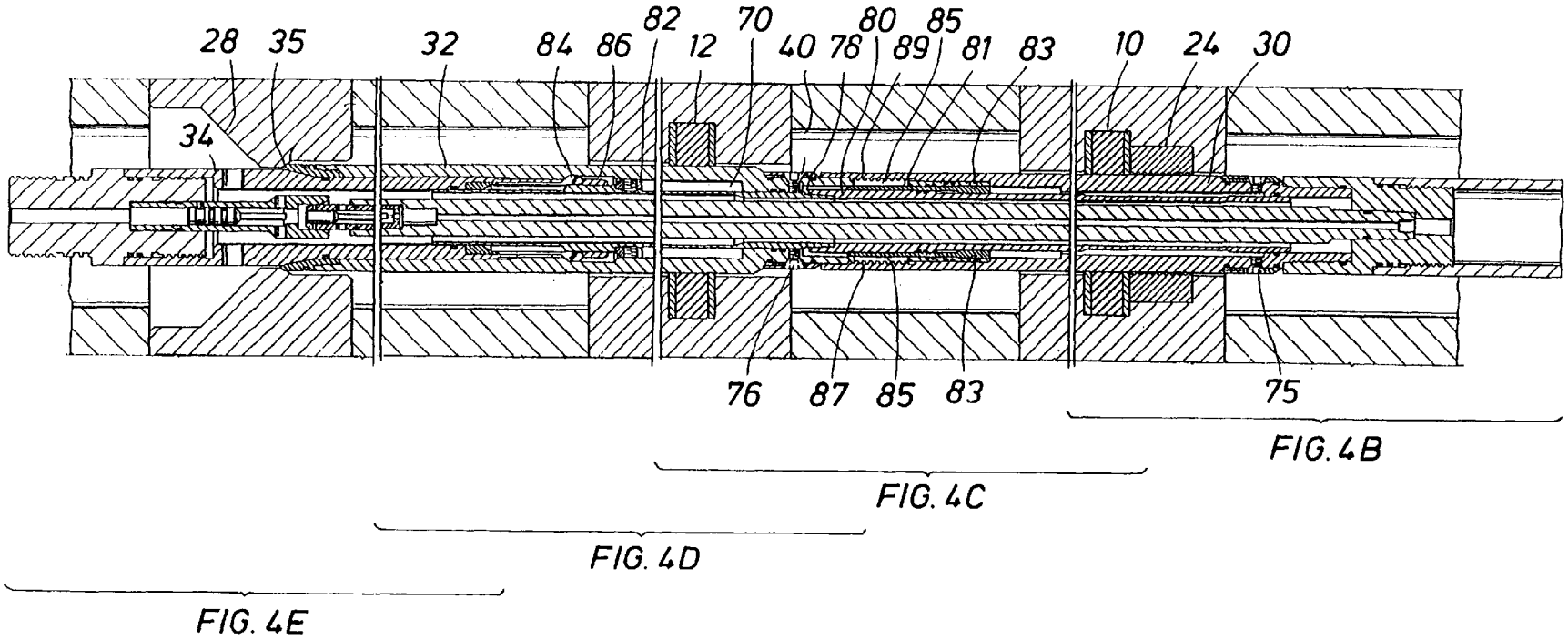
FIGS. 4A through 4E illustrate a second embodiment of a connector tool, illustrated as enclosed within deployment apparatus, FIGS. 4B through 4E being enlarged segments of FIG. 4A.
Figure 4B:
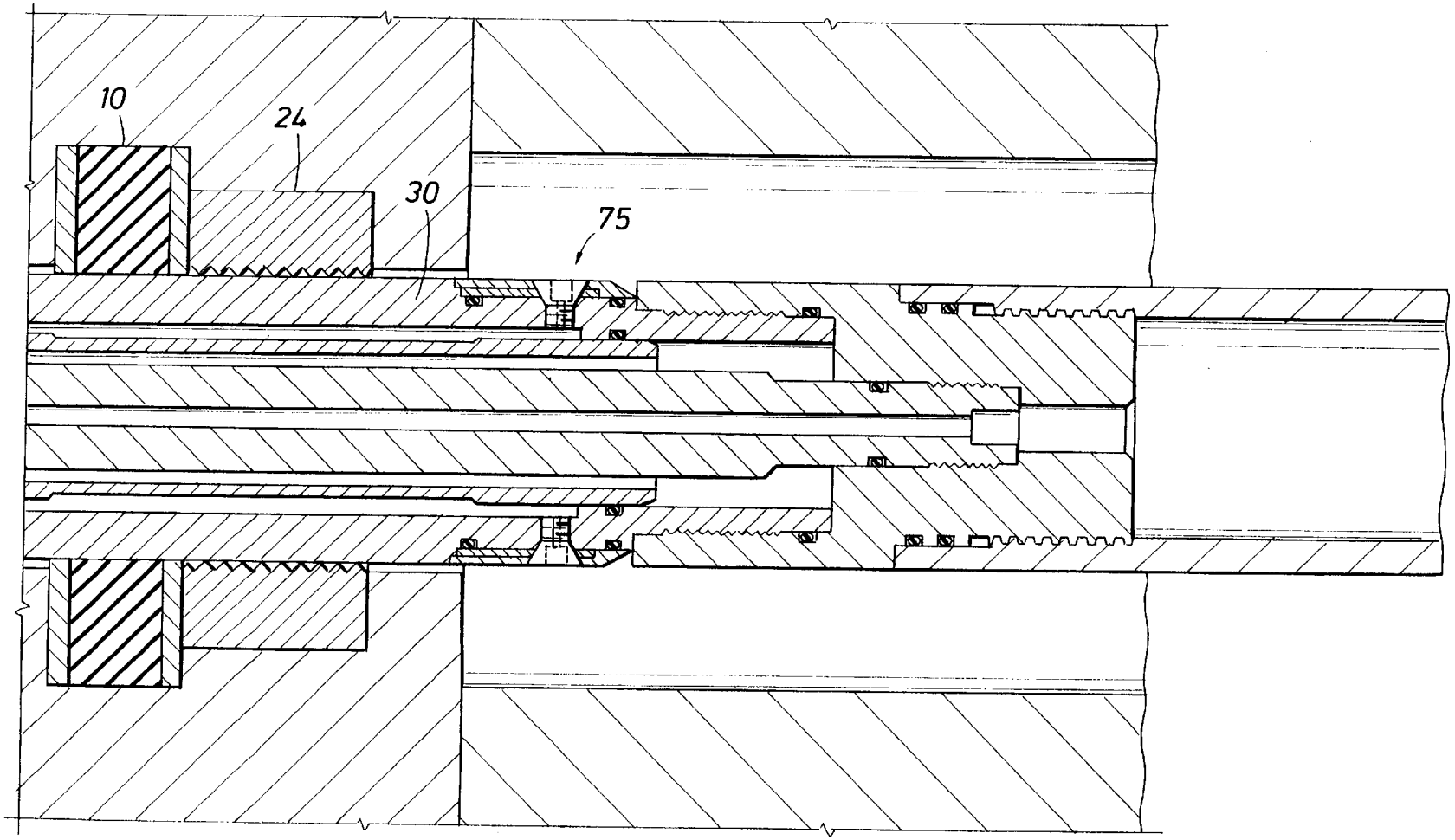
Figure 4C:
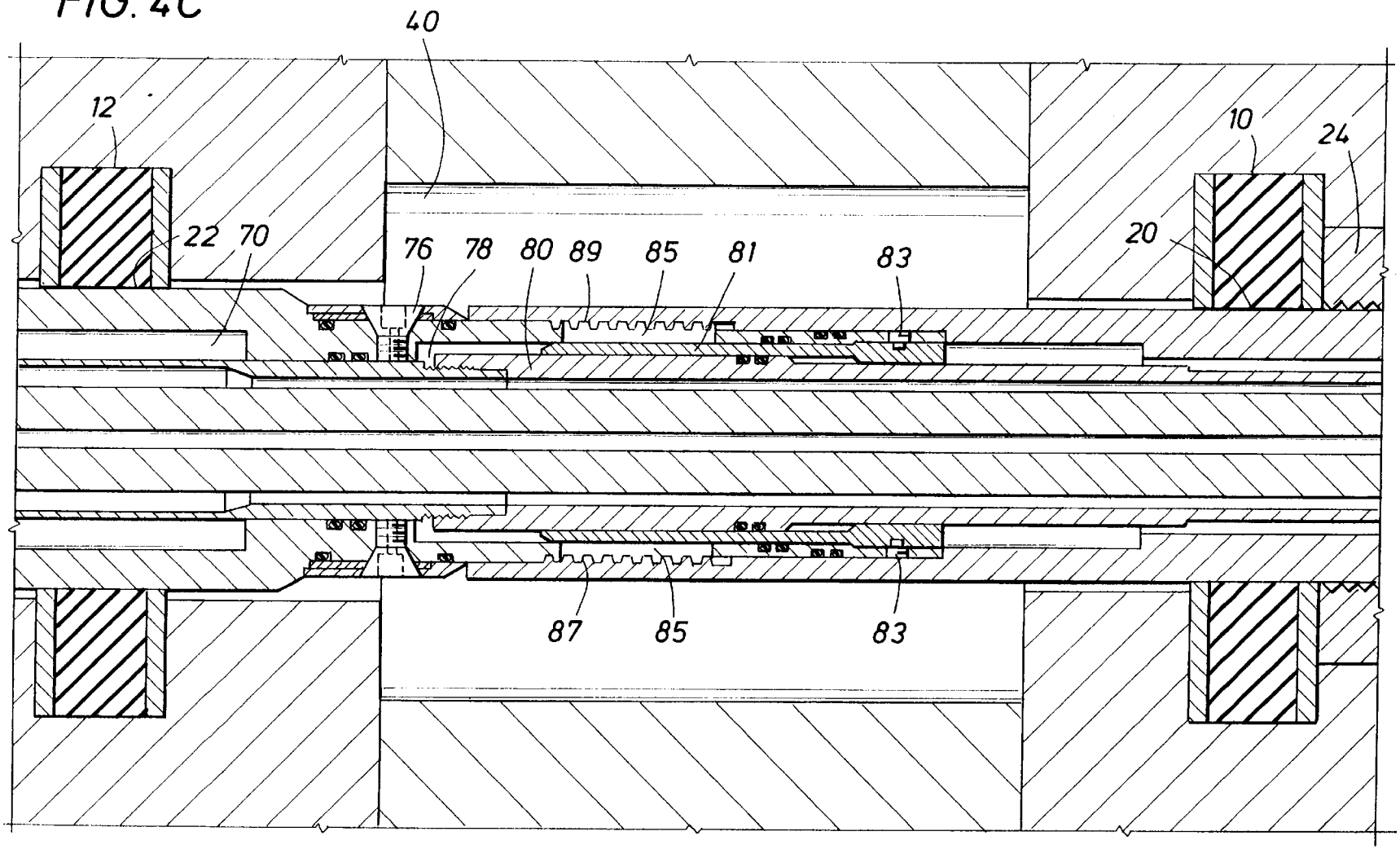
Figure 4D:
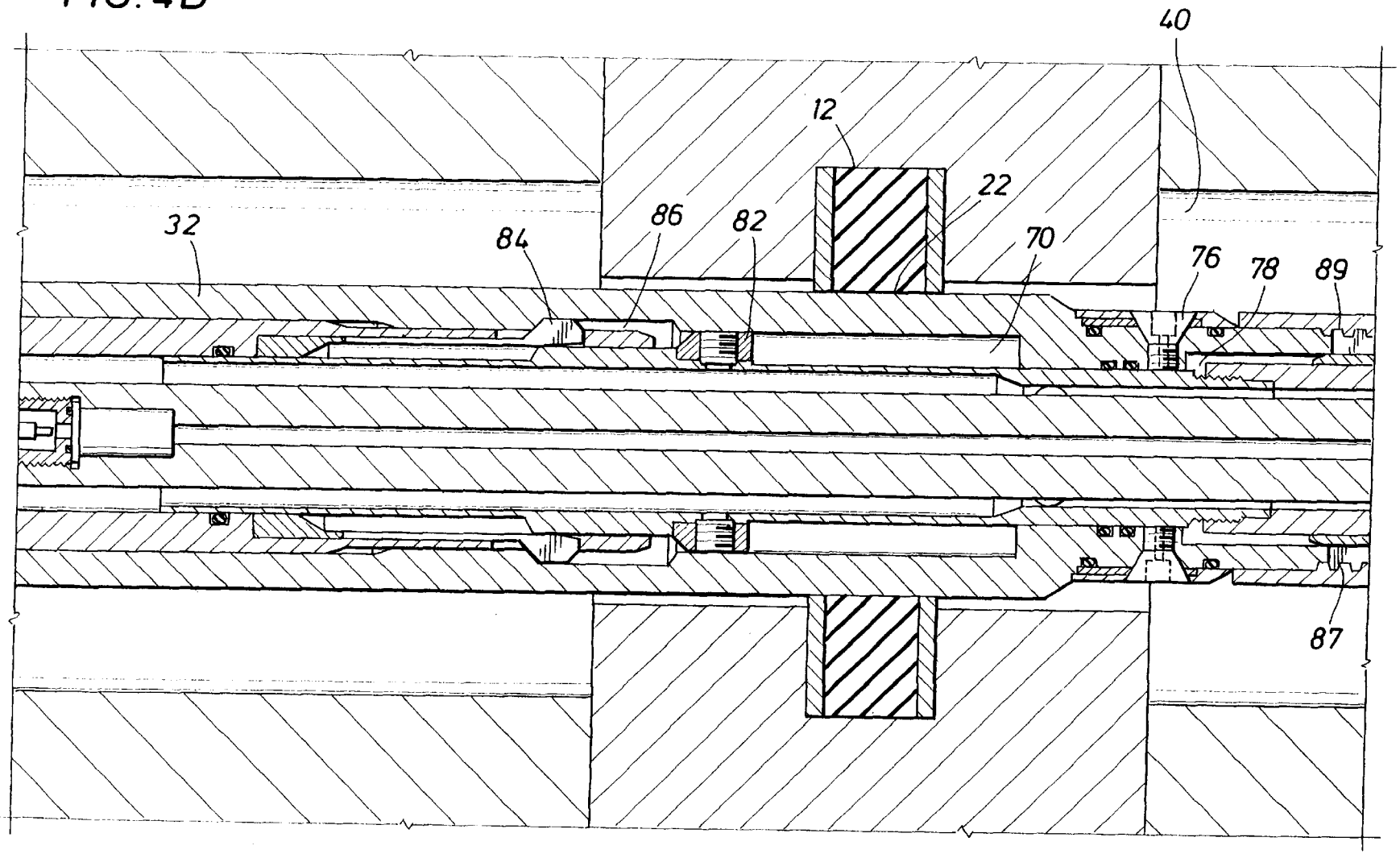
Figure 4E:
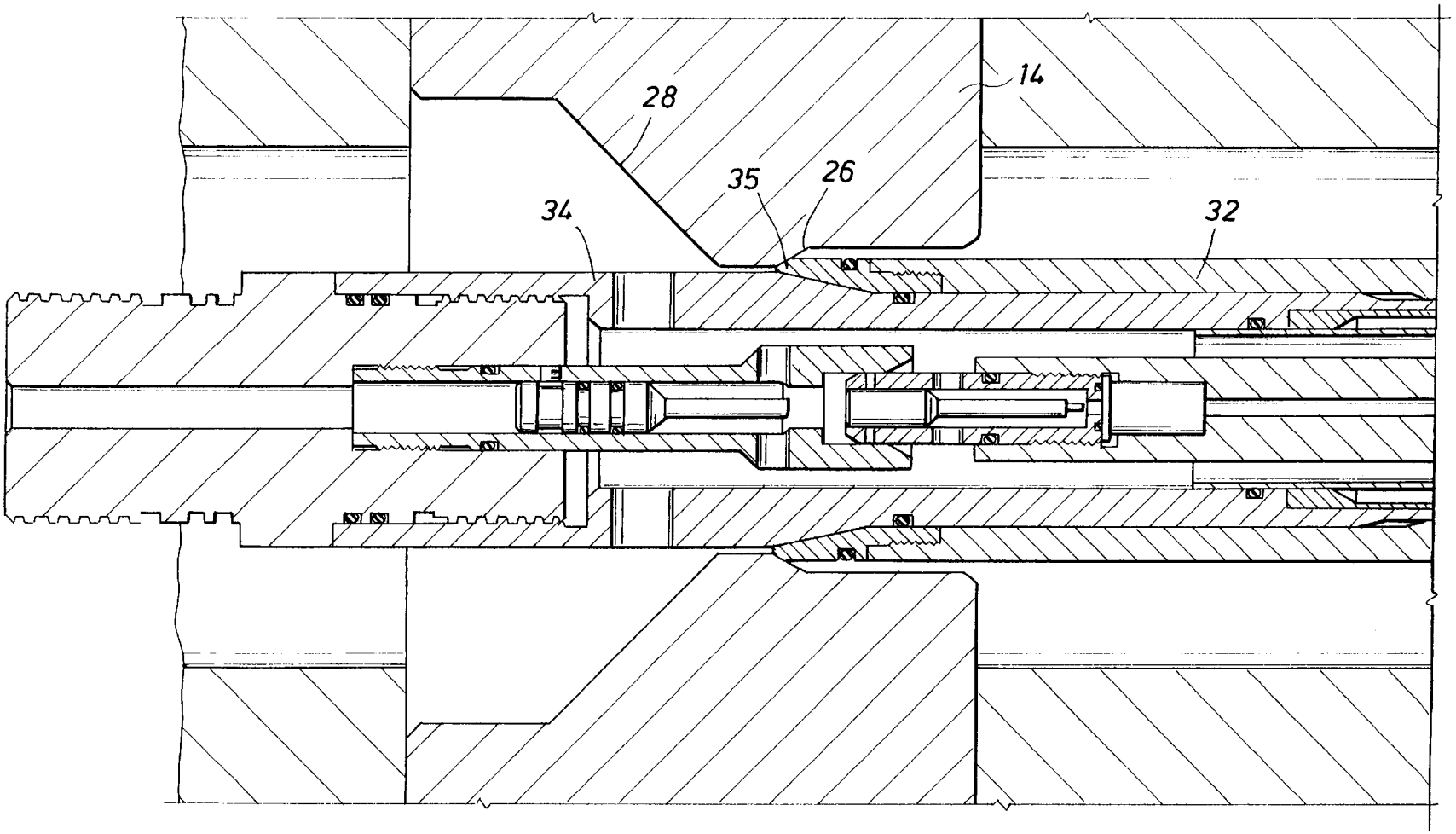

FIGS. 4A through 4E illustrate a connector tool located within at least portions of a deployment BOP. FIG. 4C illustrates piston 80 movable in its chamber via fluid pressure in chamber 78. Fluid pressure in chamber 78 comes via port 76 and pressure chamber 40. Pressure chamber 40 exists between sealing surfaces 20 and 22 of rams 10 and 12. Slip 24 is illustrated as holding lower section 30 of the connecting tool. In FIGS. 4A through 4E, the connecting tool is illustrated in its vertically or longitudinally connected position. Collet 84 of upper section 34 is illustrated as resting and biased in annular detent area 86 of the upper portion 32 of the lower section of the connector tool. Dog 82 connected to piston 80 is biasing collet 84 into annular space 86. If and when pressure is applied in chamber 40 and through port 76 to chamber 78, piston 80 will move downward or to the right. Movement of piston 80 moves dog 82 to the right and removes the element forcing and biasing collet 84 into annular area 86. A pull at such point on upper connector 34 should cause collet 84 to slide inward and permit the disengagement of the upper section 34 of the connecting tool from the upper portion 32 of the lower section of the connecting tool.

If for some reason collet 84 will not disengage from annular area or detent space 86, a second separation device is provided. If chamber 40 is pressured to an exceptionally high pressure through port 76, the extremely high pressure in chamber 78 will cause piston 81 to shear pin 83 and move downward or to the right, until it shoulders off and can no longer move to the right. At such point, key 85 will be free to retract inward and retract key 85's teeth 87 from the matching teeth 89 in the inside of the outer wall of lower portion 30 of the lower section of the connector tool. When teeth 87 retract inwardly and disengage from teeth 89, then not only can the upper section 34 the connecting tool be pulled upward but with it will go upper portion 32 of the lower section of the connecting tool.

The FIG. 4, and in particular FIG. 4B, also illustrates a second port that applies well fluid to the underside of the pistons in their chamber. The well fluid operates as a second biasing force biasing the piston to its upward position wherein the upper section of the connector tool is locked in longitudinal or vertical alignment with the lower section of the connector tool. When a lower port and lower chamber below the pistons such as port 75 is utilized, chamber 40 is used to apply a pressure differential to the upper portion of the pistons.

Figure 5:
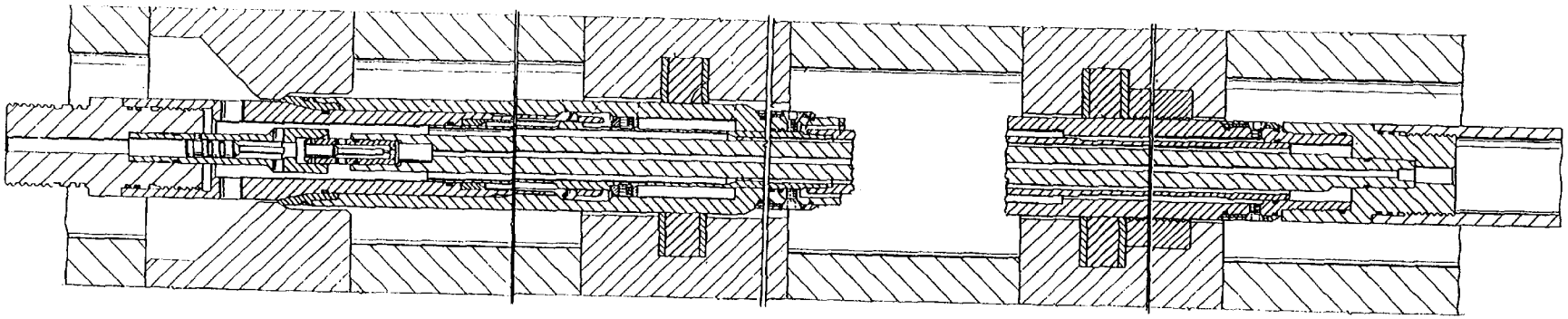
FIG. 5 illustrates a connector tool enclosed within deployment apparatus.

FIG. 5 offers a further embodiment of the present invention, similar to FIG. 4.

FIGS. 6A through 6H illustrate a universal or multi-functional coiled tubing header that comprises a portion of the present invention. FIGS. 6B through 6H offer enlarged portional views of the universal coiled tubing head of FIG. 6A.

Figure 6B:
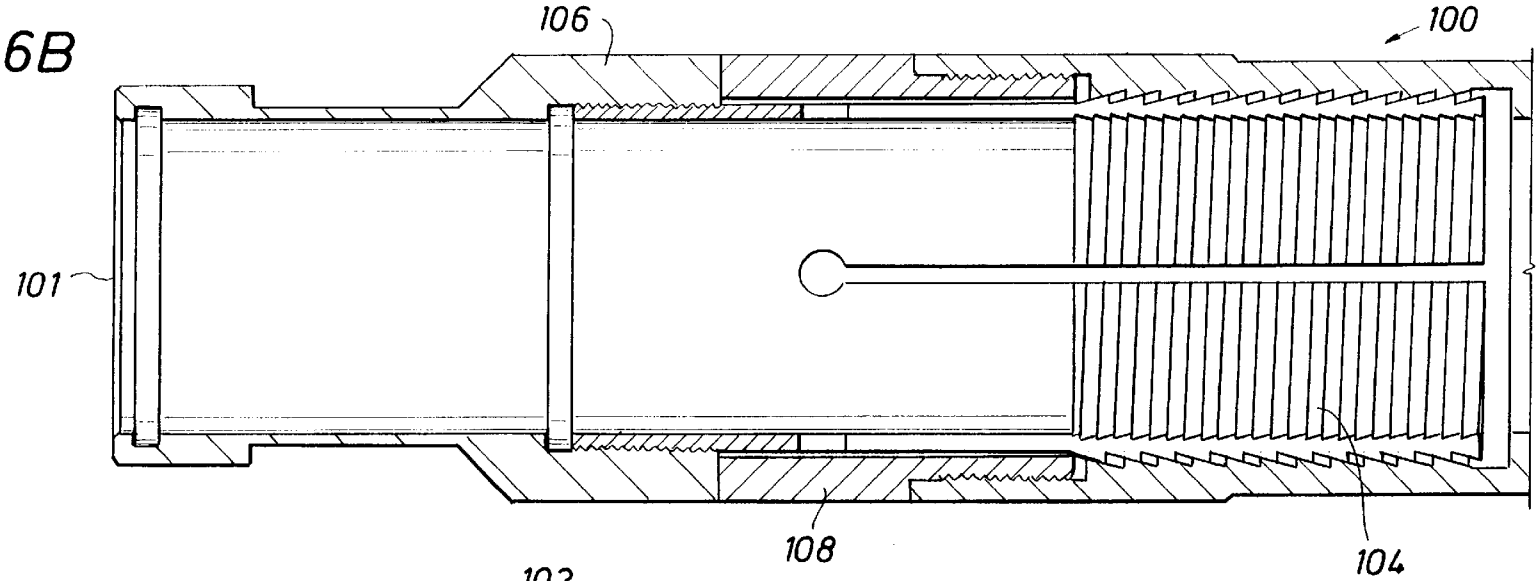
Figure 6C:
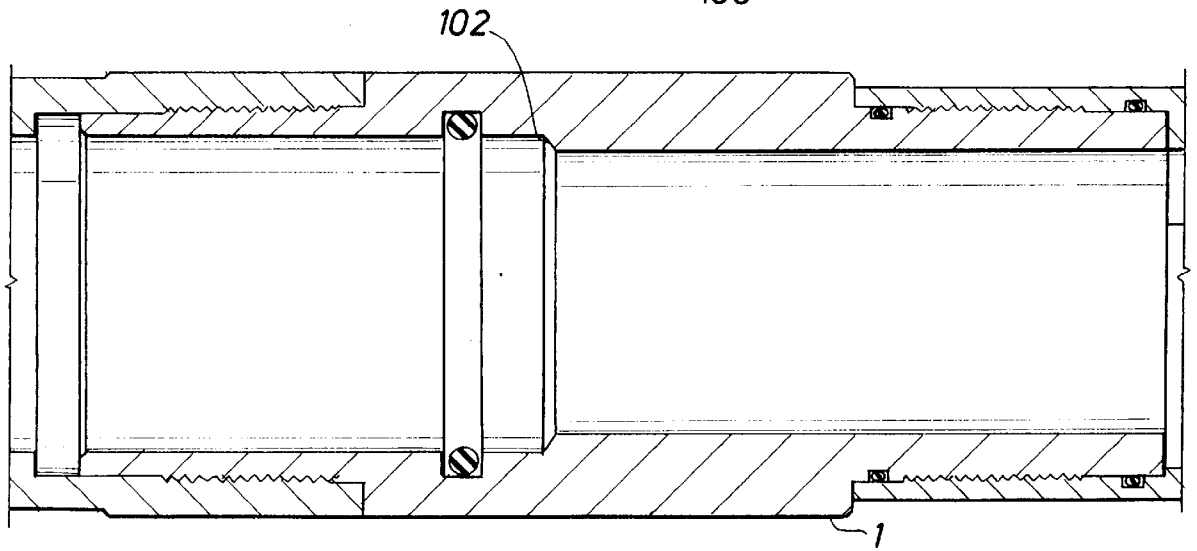

Unit 100 particularly identified in FIGS. 6B and 6C illustrates the means for connecting the multi-functional coiled tubing head to the coiled tubing. Coiled tubing is inserted in unit 100 through end 101. The coiled tubing is inserted through unit 100 until it lands on shoulder 102. Unit 106 is screwed tightly onto unit 104, placing unit 108 in compression and unit 104 in tension. Inserting the coiled tubing through unit 104, together with placing it in tension causes elements of unit 104 to bite into and latch securely onto the coiled tubing.

Figure 6D:
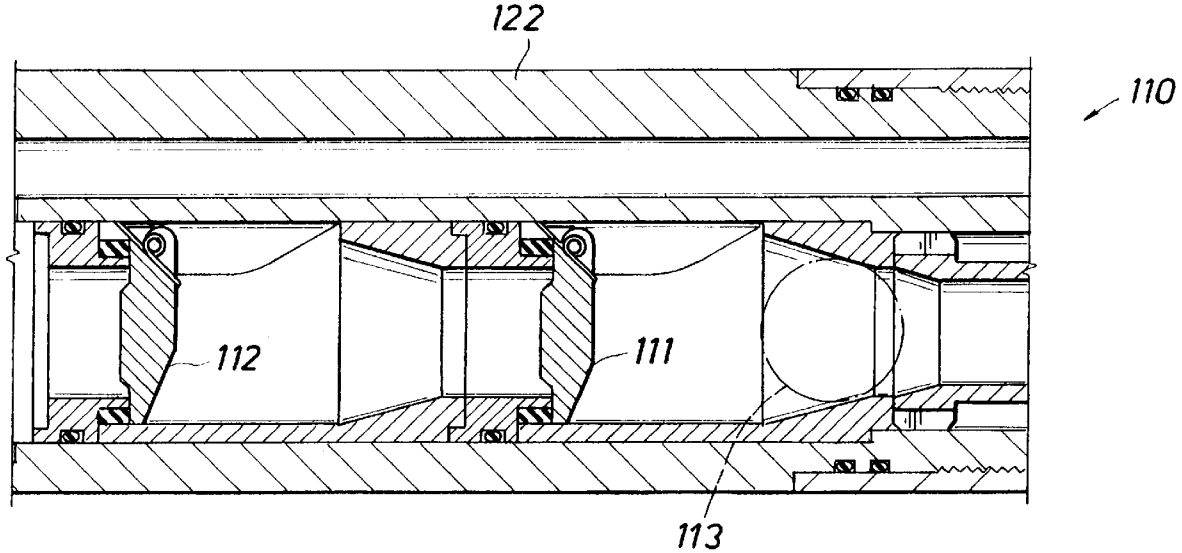
Figure 6E:
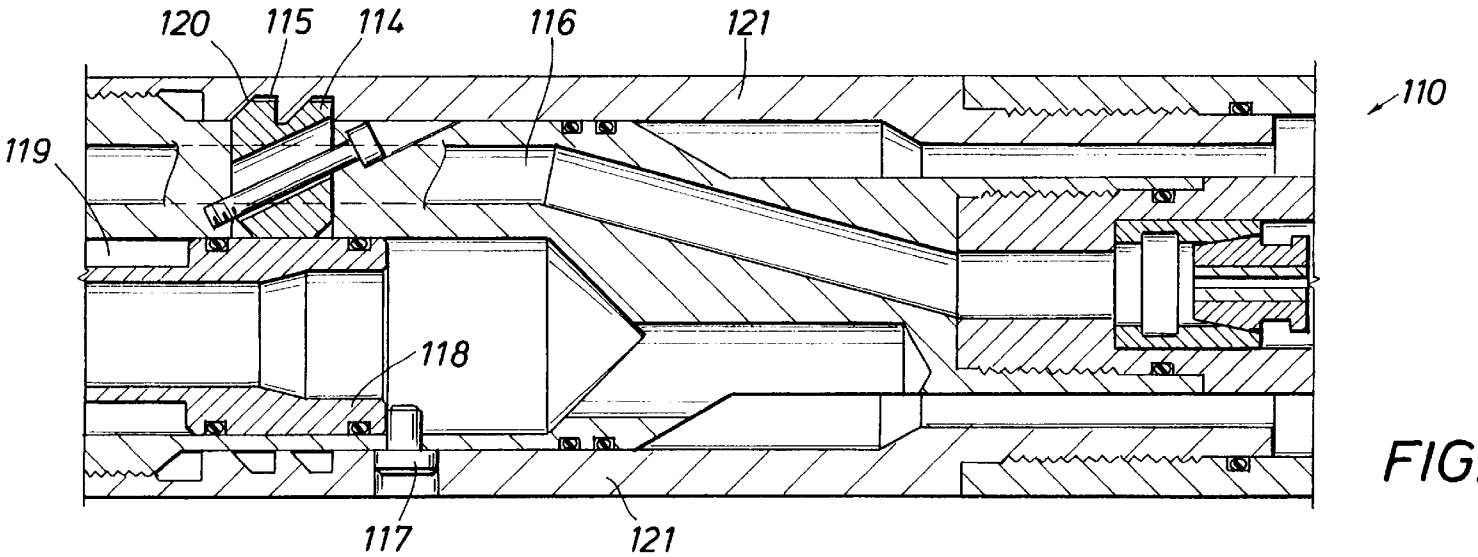

Unit 110 illustrated most particularly in FIGS. 6D and 6E illustrate check valves and a release tool within the multi-functional head. Check valves 112 and 111 sit within a fluid flow path within the multi-purpose coiled tubing head. Path 116 is provided for wireline extending through the coiled tubing to be routed around the fluid flow path. A ball 113, illustrated in dashed lines, can be pressured through check valves 112 and 111. Ball 113 seats against piston 118. When ball 113 is seated and pressured, piston 118 shears pins 117 and moves downward or to the right. As piston 118 moves downward or to the right, key 115 is allowed to retract inwardly into recess 119. As key 115 retracts inwardly into recess 119, teeth 114 on key 115 move out of recesses 120 in the side wall of unit 121 of the multi-functional coiled tubing head tool. When teeth 114 disengaged from slots 120 and unit 121, unit 122 and those elements above it can be separated and pulled out of and released from unit 121 and those elements connected to it and below it. Hence, unit 110 provides check valves and a release tool.

Wireline passes through channel 116 and unit 110 and into unit designated 130. Unit 130 is most particularly viewed in FIGS. 6E and 6F. Unit 130 provides a wireline anchor having tightening screw 131 and gripping teeth 132. Wireline from the coiled tubing is pulled through channel 116 and through gripping teeth 132. Wires from the wireline are connected to electrical outlet elements 133 in unit designated 140 of the tool. Screw 131 is tightened to force teeth 132 to grip the wireline securely and firmly by biasing a wedge against the base of teeth 132 to force them inwardly.

Figure 6F:
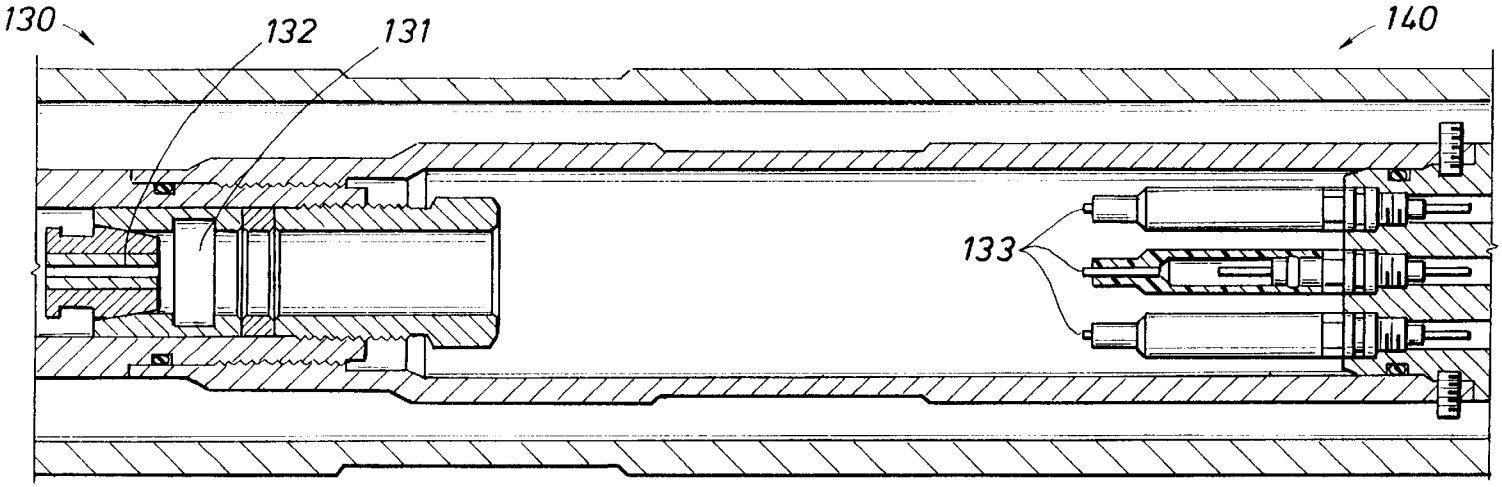
Figure 6G:
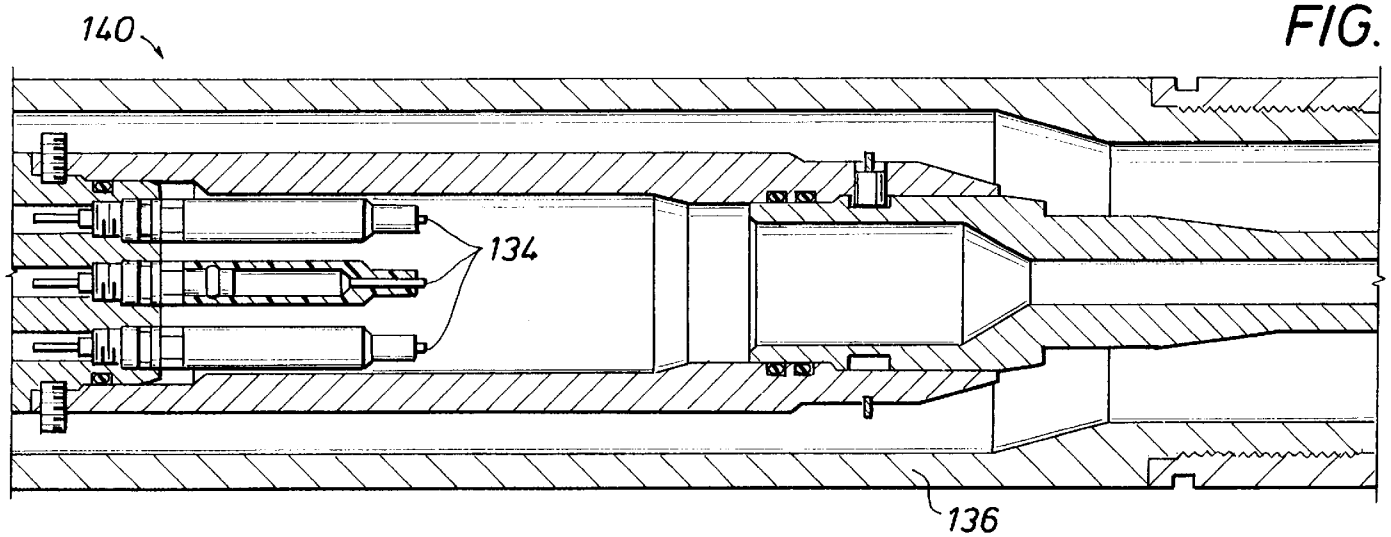
Figure 6H:
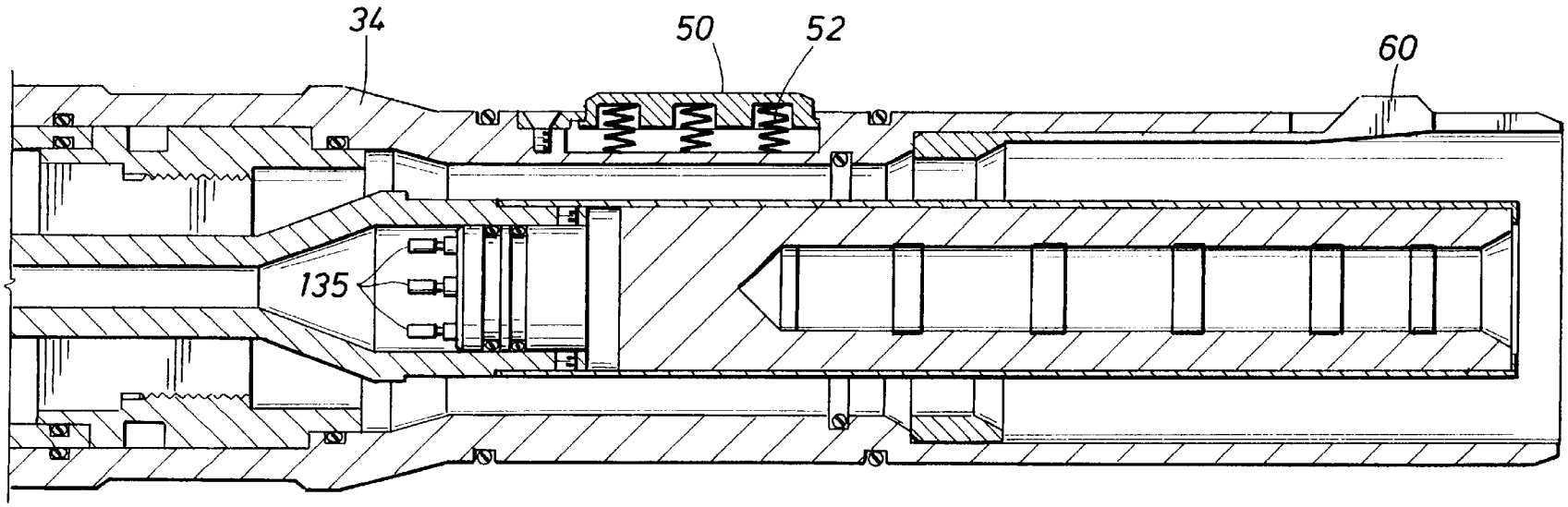

Unit 140, more particularly illustrated in FIGS. 6F and 6G illustrate an electrical bulkhead provided in the multi-purpose coiled tubing header. The electrical bulkhead connects at contacts 133 with wire from the wireline and further connects at contacts 134 via wires with contacts 135 at the top side of a top section of a connector tool. Connector tool 34 screws into lower portion 136 of the multi-purpose coiled tubing header. Connector tool section 34 is an upper section of a connector tool as discussed above.

The multi-purpose coiled tubing header thus provides a release tool to release the coiled tubing from all bottomhole assemblies as well as a wireline anchor, an electrical bulkhead and means for connecting to an upper section of a multi-purpose connector tool.

While there are shown and described present preferred embodiments of the invention, it is to be distinctly understood that the invention is not limited thereto, but may otherwise variously embodied and practiced within the scope of the following claims. ACCORDINGLY,

What is claimed is:

1. Deployment apparatus for running tools in a well, comprising:

a deployment BOP having at least one sealing ram;

a chamber defined between ram sealing surfaces and having a port for communicating fluid;

a vertical height positioning element attached to the deployment BOP; and a slip attached to the deployment BOP.

2. The apparatus of claim 1 that includes a horizontal position adjusting element attached to the deployment BOP.

3. The apparatus of claim 1 that includes a gate valve attached to the deployment BOP.

4. The apparatus of claim 3 that includes a riser attached to the gate valve.

5. The apparatus of claim 1 that includes a coiled tubing BOP attached to the deployment BOP.

6. The apparatus of claim 1 wherein the slip is associated with a ram within the BOP.

7. The apparatus of claim 1 that includes at least two sealing rams and wherein the chamber is defined between sealing surfaces of the at least two rams.

8. The apparatus of claim 1 wherein the vertical height positioning element is associated with a ram within the deployment BOP.

9. The apparatus of claim 2 wherein the horizontal position adjusting element is associated with a ram within the deployment BOP.

10. A method for deploying tools in a live well, comprising:

externally pressuring at least a portion of a first section of a connector tool in a pressure chamber at well surface;

mating a second section with the first section longitudinally; and releasing the external pressure.

11. The method of claim 10 where in the externally pressuring includes overcoming a force biasing a latch element of the first section.

12. The method of claim 10 wherein the releasing includes releasing such as to longitudinally latch the second section with the first section.

13. The method of claim 10 that includes defining at least in part the pressure chamber by moving a sealing ram against a portion of the first section body.

14. The method of claim 11 that includes overcoming a bias force by moving a piston within the first section.

15. The method of claim 10 that includes rotationally aligning the first and second sections after longitudinally mating.

16. A method for deploying tools in a live well, comprising:

externally pressuring at least a portion of a first section of a connector tool in a pressure chamber at well surface;

separating longitudinally a second section from the first section; and releasing the external pressure.

17. The method of claim 16 that includes vertically positioning a section of a connector tool with respect to the pressure chamber.

18. A connector device for well tubing and/or well tools, comprising:

a first section and a second section structured in coordination to longitudinally mate over a continuous range of relative rotational orientations;

the sections having in combination coordinating latching elements biased to retain the sections in longitudinal mating orientation; and at least one piston movable in a section in response to pressure wherein movement of the piston operates to overcome the bias.

19. The connecting device of claim 18 wherein the first section and the second section are each adapted to attach to a well tool sub.

20. The connecting device of claim 18 wherein one section includes a spring biased key and the other section includes a coordinating detent such that in at least one relative rotational alignment the key seats in the detent.

21. A connector device for connecting modules to be deployed downhole, comprising:

a first section;

a second section;

a piston attached to one section biased to resist movement;

means for translating fluid pressure external to the tool into a force against the piston; and means for connecting the first section and the second section upon movement of the piston.

22. A connector device for connecting modules to be deployed downhole, comprising:

a first section;

a second section;

a piston attached to one section biased to resist movement;

means for translating fluid pressure external to the tool into a force against the piston; and means for disconnecting the first section and the second section upon movement of the piston.

23. The device of claim 21 wherein the means for connecting includes providing a longitudinal connection while leaving the first section and the second section free for relative rotational movement.

24. The device of claim 23 that includes means for fixing relative rotational movement between the first section and the second section subsequent to connecting longitudinally the first section and the second section.

25. A coiled tubing head for use in running tools with coiled tubing downhole in a well, comprising:

a coiled tubing connector tool;

a wireline anchor attached to the coiled tubing connector tool;

an electrical bulkhead attached to the coiled tubing connector tool;

a release tool attached to the coiled tubing connector tool;

check valves attached to the coiled tubing connector tool; and a downhole tool connecter device connected to the coiled tubing connecting tool.

* * * * *